US007524602B2

(12) United States Patent
Vanbesien et al.

(10) Patent No.: US 7,524,602 B2
(45) Date of Patent: Apr. 28, 2009

(54) LOW MOLECULAR WEIGHT LATEX AND TONER COMPOSITIONS COMPRISING THE SAME

(75) Inventors: Daryl Vanbesien, Burlington (CA); Karen A. Moffat, Brantford (CA); Emily L. Moore, Mississauga (CA); Kimberly D. Nosella, Mississauga (CA); David J. Sanders, Oakville (CA); Christine Anderson, Hamilton (CA); Cuong Vong, Hamilton (CA)

(73) Assignee: Xerox Corporation, Norwalk, CT (US)

( * ) Notice: Subject to any disclaimer, the term of this patent is extended or adjusted under 35 U.S.C. 154(b) by 453 days.

(21) Appl. No.: 11/156,967

(22) Filed: Jun. 20, 2005

(65) Prior Publication Data

US 2006/0286476 A1 Dec. 21, 2006

(51) Int. Cl.
*G03G 9/08* (2006.01)

(52) U.S. Cl. ..... 430/108.7; 430/109.1; 430/137.15

(58) Field of Classification Search ..... 430/108.7, 430/109.1, 137.15
See application file for complete search history.

(56) References Cited

U.S. PATENT DOCUMENTS

| | | | |
|---|---|---|---|
| 4,298,672 | A | 11/1981 | Lu |
| 4,332,390 | A | 6/1982 | Bury |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,783 | A | 9/1994 | Scarborough et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,943 | A | 12/1998 | Cheng et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,925,488 | A | 7/1999 | Patel et al. |
| 5,928,830 | A | 7/1999 | Cheng et al. |
| 5,977,210 | A | 11/1999 | Patel et al. |
| 5,994,020 | A | 11/1999 | Patel et al. |
| 6,020,101 | A | 2/2000 | Sacripante et al. |
| 6,120,967 | A | 9/2000 | Hopper et al. |
| 6,130,021 | A | 10/2000 | Patel et al. |
| 6,628,102 | B2 | 9/2003 | Batson |
| 6,841,329 | B2 * | 1/2005 | Nguyen et al. ..... 430/137.14 |
| 6,942,954 | B2 * | 9/2005 | Patel et al. ..... 430/137.1 |
| 2005/0042535 | A1 * | 2/2005 | Vanbesien et al. ..... 430/110.3 |

* cited by examiner

*Primary Examiner*—John L Goodrow
(74) *Attorney, Agent, or Firm*—Eugene O. Palazzo; Fay Sharpe LLP

(57) ABSTRACT

Provided are a latex process and a toner process, both of which include the preparation of a latex having weight average molecular weight of from about $12\times10^3$ to about $24\times10^3$. The latex is manufactured under monomer-starved polymerization condition such as monomer feeding rate equal to or less than 0.516% per minute by weight of the monomer(s) to be fed. The toners prepared according to the present disclosure have gained improved properties such as gloss, fusing performance, crease performance, stripping performance, document offset, vinyl offset, and parent charging etc.

18 Claims, 15 Drawing Sheets

LOW MOLECULAR WEIGHT LATEX AND TONER COMPOSITIONS COMPRISING THE SAME

BACKGROUND

The present disclosure is generally directed, in various embodiments, to a process for producing low molecular weight latex. The latex so produced is utilized to generate emulsion aggregation toners. More particularly, the process includes preparing latex having lower weight average molecular weight under a monomer-starved polymerization conditions. The toner particles prepared according to the present disclosure have one or more enhanced properties such as gloss, fusing performance, crease performance, stripping performance, document offset, vinyl offset, parent charging, etc.

In general, E/A (emulsion/aggregation/coalescence) processes are known to fabricate toners. Emulsion polymerization typically comprises forming an emulsion of a surfactant and monomer in water, then polymerizing the monomer in the presence of a water soluble initiator. For example, U.S. Pat. No. 5,853,943, the disclosure of which is totally incorporated herein by reference in its entirety, is directed to a semi-continuous emulsion polymerization process for preparing a latex by first forming a seed polymer. U.S. Pat. No. 5,928,830, the disclosure of which is also totally incorporated herein by reference in its entirety, is directed to a semi-continuous emulsion polymerization process for preparing a latex preparation of a latex polymer with a core encapsulated within a shell polymer, wherein a toner prepared with said latex polymer exhibits good fix and gloss characteristics.

EA toners produced by the above processes or other are generally ultrafine particle toners with precisely controlled particle size, size distribution, and particle shape. General EA processes for the preparation of toners are also illustrated in a number of Xerox patents, the disclosures of each of which are totally incorporated herein by reference, such as U.S. Pat. Nos. 5,290,654; 5,278,020; 5,308,734; 5,370,963; 5,344,738; 5,403,693; 5,418,108; 5,364,729; and 5,346,797. Also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488; 5,977,210; 5,994,020; 6,020,101; 6,130,021; 6,120,967 and 6,628,102. The disclosures of these patents are also totally incorporated herein by reference.

For some applications in the graphics arts market, high gloss images are desired. For example, styrene/n-butyl acrylate emulsion/aggregation (E/A) toners for certain oil and oil-less fusers such as 80 PPM Belt Fuser fixtures require high gloss images.

BRIEF DESCRIPTION

The present disclosure provides, in various exemplary embodiments, a process for producing a latex and, optionally, a process for utilizing the latex to produce a toner. Both of these processes include the preparation of a latex having weight average molecular weight of from about $12\times10^3$ to about $25\times10^3$. The latex is manufactured under monomer-starved polymerization conditions, such as monomer feeding rate equal to or less than 0.516% per minute by weight of the monomer(s) to be fed. Advantageously, the toners prepared according to the present disclosure have one or more enhanced properties such as gloss, fusing performance, crease performance, stripping performance, document offset, vinyl offset, parent charging, etc.

In another exemplary embodiment, the present disclosure relates to a latex production process for the preparation of a latex having weight average molecular weight of from about $12\times10^3$ to about $25\times10^3$ which comprises (a) preparing a latex seed comprising a first monomer composition, an initiator and an optional chain transfer agent by emulsion polymerization; and (b) feeding a second monomer composition to the latex seed under monomer-starved polymerization conditions to form the latex. In an additional embodiment, the latex produced by such a process is also included.

In a further exemplary embodiment, the monomer-starved polymerization condition of the latex process comprises a feeding rate of the second monomer composition into the latex seed equal to or less than 0.516% per minute by weight of the monomer(s) to be fed. A further embodiment of the disclosure includes the latex produced by this process.

Another exemplary embodiment of the present disclosure concerns a toner preparation process comprising (a) preparing a latex seed comprising a first monomer composition, an initiator and an optional chain transfer agent by emulsion polymerization;

(b) feeding a second monomer composition to the latex seed under monomer-starved polymerization conditions to form a latex having weight average molecular weight of from about $12\times10^3$ to about $25\times10^3$; and (c) mixing the latex with a colorant dispersion, a wax dispersion, and a coagulant. The toner produced by this process is also included as another embodiment.

A still further embodiment of the present disclosure is to provide a toner, which is prepared from a toner formulation comprising a latex having weight average molecular weight of from about $12\times10^3$ to about $25\times10^3$, a colorant dispersion, a wax dispersion, a coagulant, and an optional ingredient selected from the group consisting of silica, a charge enhancing additive or charge control additive, a surfactant, an emulsifier, a flow additive, and the mixture thereof. The toner can produce an image having a gloss value significantly higher than toner prepared from a formulation comprising a latex having a weight average molecular weight higher than about $25\times10^3$.

These and other non-limiting embodiments will be more particularly described with regard to the drawings and detailed description set forth below.

BRIEF DESCRIPTION OF THE DRAWINGS

The following is a brief description of the drawings, which are presented for the purposes of illustrating the development disclosed herein and not for the purposes of limiting the same.

DETAILED DESCRIPTION

Figure 1:
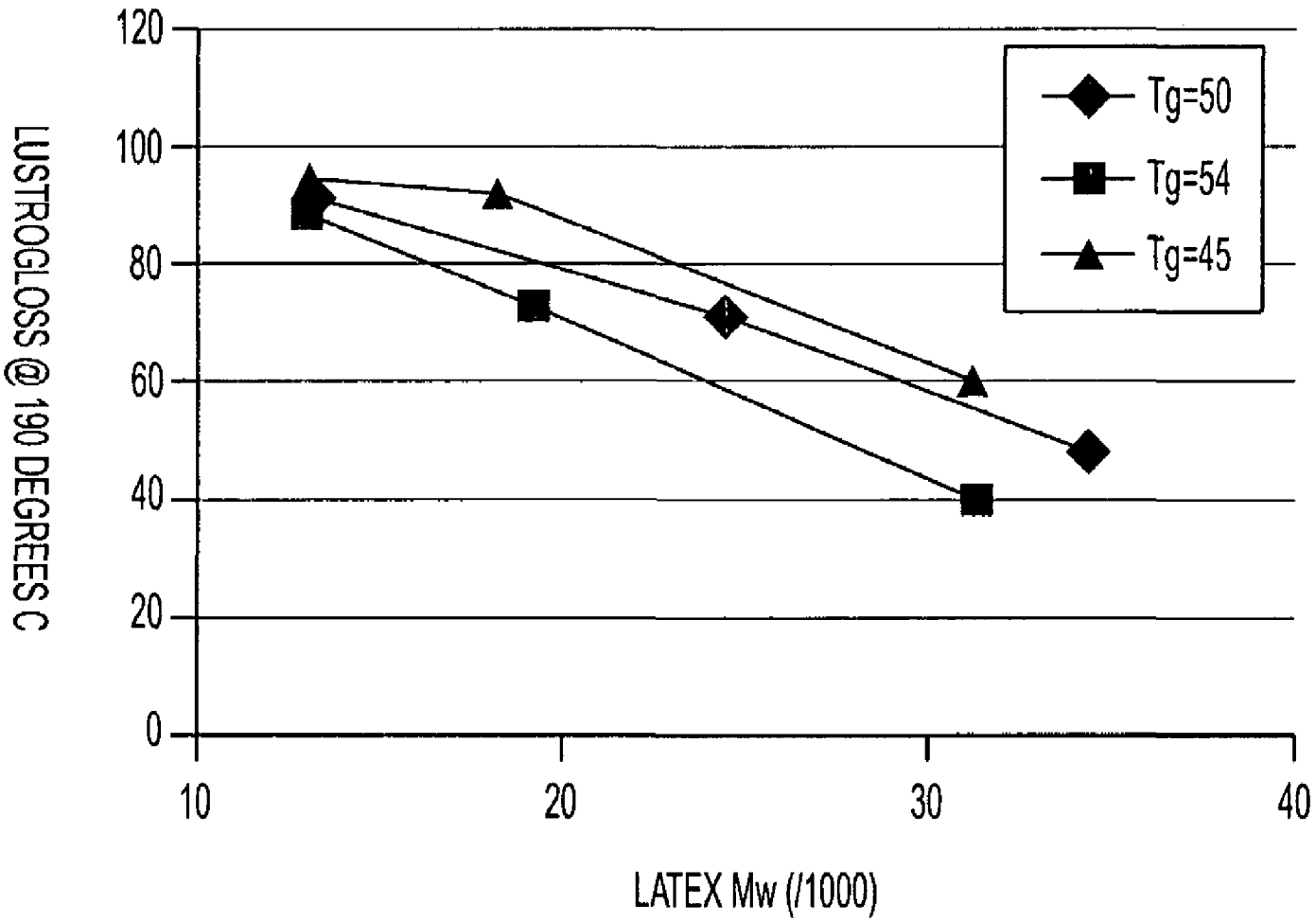
FIG. 1 shows the correlation between toner gloss versus toner latex molecular weight for various E/A cyan toners according to an embodiment of the present disclosure.

The present disclosure is generally directed to various embodiments of a process for producing latex and a toner composition comprising the same. More particularly, the latex preparation process and the toner preparation process both include preparing latex having lower weight average molecular weight under monomer-starved polymerization conditions. The toner particles prepared according to the present disclosure have one or more enhanced properties such as gloss, fusing performance, crease performance, stripping performance, document offset, vinyl offset, parent charging, etc.

While any suitable emulsion polymerization may be used in the latex preparation process and the toner preparation process of the present disclosure, typically seed emulsion polymerization techniques are utilized. That is, seed latexes are first formed from the polymerization of a first monomer composition, and subsequently a second monomer composition is added to the seed latexes.

The use of seed latex significantly reduces batch-to-batch variations in the emulsion polymerization process. Moreover, for toner preparation, in situ seed formation at the beginning of a reaction is simplified since no additional reactor is needed to formulate the seed latexes.

As such, the present disclosure provides a process for the preparation of a latex having weight average molecular weight of from about $12\times10^3$ to about $25\times10^3$ (hereinafter "the latex process"), which comprises (a) preparing a latex seed comprising a first monomer composition, an initiator and an optional chain transfer agent by emulsion polymerization; and (b) feeding a second monomer composition to the latex seed under monomer-starved polymerization conditions to form the latex.

In other exemplary embodiments, the latex prepared from the above process is used to produce toner particles. Therefore, the present disclosure also provides a toner preparation process (hereinafter "the toner process") comprising (a) preparing a latex seed comprising a first monomer composition, an initiator and an optional chain transfer agent by emulsion polymerization;

(b) feeding a second monomer composition to the latex seed under monomer-starved polymerization condition to form a latex having weight average molecular weight of from about $12\times10^3$ to about $25\times10^3$; and (c) mixing the latex with a colorant dispersion, a wax dispersion, and a coagulant to form a toner composition.

In typical embodiments, the latex process is part of the toner process. In this sense, the latex having weight average molecular weight of from about $12\times10^3$ to about $25\times10^3$ may be regarded as the final product of the latex process, or as an intermediate product of the toner process.

According to exemplary embodiments, the latex generally has a weight average molecular weight of from about $12\times10^3$ to about $25\times10^3$, including from about $15\times10^3$ to about $23\times10^3$, and from about $18\times10^3$ to about $22\times10^3$, and from about $19\times10^3$ to about $21\times10^3$, and from about $19\times10^3$ to about $20\times10^3$.

In typical embodiments, the latex generally has an average particle size of from about 100 nm to about 300 nm, generally from about 120 nm to about 280 nm, and more typically from about 150 nm to about 250 nm.

It is to be understood herein, that if a "range" or "group" is mentioned with respect to a particular characteristic of the present disclosure, for example, molecular weight, feed rate, chemical species, and temperature etc., it relates to and explicitly incorporates herein each and every specific member and combination of sub-ranges or sub-groups therein whatsoever. Thus, any specified range or group is to be understood as a shorthand way of referring to each and every member of a range or group individually as well as each and every possible sub-ranges or sub-groups encompassed therein; and similarly with respect to any sub-ranges or sub-groups therein.

To obtain the target latexes as described above, typical embodiments of the present disclosure employ semi-continuous batch emulsion polymerization using monomer-starved conditions to allow complete control of, for example, molecular weight, etc. A controlling factor of the monomer-starved condition is monomer feeding rate into the emulsion polymerization system. Monomer-starved polymerization may be achieved by using a monomer emulsion feed rate in which the rate of monomer introduced into the reaction vessel is less than the maximum rate of polymerization. Under these conditions, the concentration of monomer in the latex particles falls below the saturation value and is controlled by the rate of monomer addition. If monomer-starved conditions are not met, then the monomer feed rate is greater than the maximum rate of polymerization, and monomer-flooded conditions occur which resemble batch reaction conditions. When this occurs, excess heat is generated very rapidly (exotherm) and polymerization reaction rate increases dramatically. This causes the molecular weight to increase rapidly from the desired target and prevents a strict control of molecular weight. Therefore, by maintaining monomer-starved conditions and avoiding monomer-flooded conditions in a semi-continuous batch polymerization, latex molecular weight can be controlled in a reproducible manner, and a low molecular weight latex to make toner which fuses with high gloss properties can be obtained. More details of monomer-starved polymerization may be found in Lovell, P. A. and El-Aasser, M. S., Emulsion Polymerization and Emulsion Polymers, John Wiley and Sons, Chichester, 1997, the disclosure of which is totally incorporated herein by reference.

The monomer feeding rate, for example, the feeding rate of the second monomer composition into the latex seed, is generally equal to or less than 0.516% per minute by weight of the monomer(s) to be fed (abbreviated as 0.516% wt/min), for example from about 0.300% wt/min to about 0.516% wt/min, including from about 0.400% wt/min to about 0.500% wt/min, and from about 0.450% wt/min to about 0.500% wt/min.

In typical embodiments, the latex process of the disclosure is reproducible and scaleable. In a single operation of the latex process, the latex output may be generally at least about 0.5 kilograms, including at least about 10 kilograms, and at least about 100 kilograms.

For example, as the latex formulation and process is scaled-up from a 2 liter Buchi reactor scale to a 5 gallon metal reactor to a 100 or 300 gallon metal reactor, similar or even identical molecular weight properties of the resulting latex can be obtained, provided the monomer-starved polymerization conditions are maintained through the reaction.

In exemplary embodiments, the monomer-starved polymerization condition optionally comprises a controlled ratio between the total monomer and the total initiator. The total monomer herein is defined as the total amount of the monomers from the first monomer composition and the second monomer composition. Generally, the ratio between the total monomer and the total initiator may be in the range of from about 5 kilograms to about 30 kilograms of total monomer per mole of initiator, including from about 8 kilograms to about 25 kilograms of total monomer per mole of initiator, and from about 12 kilograms to about 20 kilograms of total monomer per mole of initiator.

For example, as the initiator concentration is decreased relative to the weight of molar equivalents of monomer used, the molecular weight of the latex product generally increases.

When a chain transfer agent is present in the latex process or the toner process, the monomer-starved polymerization condition optionally comprises a controlled ratio between the total monomer and the total chain transfer agent. Generally, the ratio may be in the range of from about 1 kilograms to about 20 kilograms of total monomer per mole of chain transfer agent, including from about 3 kilograms to about 17 kilograms of total monomer per mole of chain transfer agent, and from about 5 kilograms to about 14 kilograms of total monomer per mole of chain transfer agent.

In specific embodiments, the latex process may be conducted by (i) preparing or providing a surfactant solution in water such as de-ionized water, optionally purged with inert gas such as nitrogen;

(ii) heating the surfactant solution to an elevated temperature of from about 65° C. to about 95° C., such as 76° C.;

(iii) preparing or providing an initiator solution in water such as de-ionized water;

(iv) preparing or providing a first monomer composition in emulsion;

(v) adding the first monomer composition into the surfactant solution;

(vi) adding at least a portion of the initiator solution into the surfactant solution before, during or simultaneously with the adding of the first monomer composition, thereby forming a latex seed; and (vii) feeding a second monomer composition, which may be the same as or different from the first monomer composition, into the latex seed under monomer-starved polymerization condition, thereby forming a latex having weight average molecular weight of from about $12\times10^3$ to about $25\times10^3$.

In specific embodiments, the toner process may be conducted by (i) preparing or providing a surfactant solution in water such as de-ionized water, optionally purged with inert gas such as nitrogen;

(ii) heating the surfactant solution to an elevated temperature of from about 65° C. to about 95° C., such as 76° C.;

(iii) preparing or providing an initiator solution in water such as de-ionized water;

(iv) preparing or providing a first monomer composition in emulsion;

(v) adding the first monomer composition into the surfactant solution;

(vi) adding at least a portion of the initiator solution into the surfactant solution before, during or simultaneously with the adding of the first monomer composition, thereby forming a latex seed;

(vii) feeding a second monomer composition, which may be the same as or different from the first monomer composition, into the latex seed under monomer-starved polymerization condition, thereby forming a latex having weight average molecular weight of from about $12\times10^3$ to about $25\times10^3$;

(viii) mixing a first portion of the latex with a colorant dispersion, a wax dispersion, and a coagulant, thereby forming a toner slurry;

(ix) heating the toner slurry at or below the glass transition temperature of the latex polymer to form toner sized aggregates;

(x) adding a second portion of the latex into the toner sized aggregates;

(xi) adjusting the pH of the emulsion system with a base from a pH of about 2.0 to about 2.5, to a pH of about 6.5 to about 7.0 to prevent, or minimize additional particle growth;

(xii) heating the toner sized aggregates at a coalescence temperature which is above the glass transition temperature of the latex polymer, thereby coalescing the toner sized aggregates into toner particles;

(xiii) optionally treating the toner particles with acidic solutions; and (xiv) optionally isolating, washing, and drying the toner particle.

Any suitable monomer or mixture of monomers may be selected to prepare the first monomer composition and the second monomer composition. The selection of monomer or mixture of monomers for the first monomer composition is independent of that for the second monomer composition, and vise versa. Exemplary monomers for the first and/or the second monomer compositions include, but are not limited to, styrene, alkyl acrylate such as methyl acrylate, ethyl acrylate, butyl arylate, isobutyl acrylate, dodecyl acrylate, n-octyl acrylate, 2-chloroethyl acrylate; β-carboxy ethyl acrylate (β-CEA), phenyl acrylate, methyl alphachloroacrylate, methyl methacrylate, ethyl methacrylate, butyl methacrylate, butadiene, isoprene; methacrylonitrile, acrylonitrile; vinyl ethers such as vinyl methyl ether, vinyl isobutyl ether, vinyl ethyl ether and the like; vinyl esters such as vinyl acetate, vinyl propionate, vinyl benzoate, vinyl butyrate; vinyl ketones such as vinyl methyl ketone, vinyl hexyl ketone, methyl isopropenyl ketone and the like; vinylidene halides such as vinylidene chloride, vinylidene chlorofluoride and the like; N-vinyl indole, N-vinyl pyrrolidene and the like; methacrylate, acrylic acid, methacrylic acid, acrylamide, methacrylamide, vinylpyridine, vinylpyrrolidone, vinyl-N-methylpyridinium chloride, vinyl naphthalene, p-chlorostyrene, vinyl chloride, vinyl bromide, vinyl fluoride, ethylene, propylene, butylene, isobutylene, and the like, and the mixture thereof. In case a mixture of monomers is used, typically the latex polymer will be a copolymer.

In some embodiments, the first monomer composition and the second monomer composition may independently of each other comprise two or three or more different monomers. The latex polymer therefore comprises a copolymer. Illustrative examples of such latex copolymer include poly(styrene-n-butyl acrylate-β-CEA), poly(styrene-alkyl acrylate), poly (styrene-1,3-diene), poly(styrene-alkyl methacrylate), poly (alkyl methacrylate-alkyl acrylate), poly(alkyl methacrylate-aryl acrylate), poly(aryl methacrylate-alkyl acrylate), poly (alkyl methacrylate), poly(styrene-alkyl acrylate-acrylonitrile), poly(styrene-1,3-diene-acrylonitrile), poly (alkyl acrylate-acrylonitrile), poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylonitrile), poly(styrene-butyl acrylate-acrylononitrile), and the like.

In typical embodiments, the first monomer composition and the second monomer composition are preferably substantially water insoluble, generally hydrophobic, and can be readily dispersed in the aqueous phase with adequate stirring when added to the reaction vessel.

The weight ratio between the first monomer composition and the second monomer composition may be generally in the range of from about 0.1:99.9 to about 50:50, including the range of from about 0.5:99.5 to about 25:75, and in the range of from about 1:99 to about 10:90. In a specific embodiment, the weight ratio between the first monomer composition and the second monomer composition is about 1:99.

In a specific embodiment, the first monomer composition and the second monomer composition are the same. Examples of the first/second monomer composition may be a mixture comprising styrene and alkyl acrylate such as a mixture comprising styrene, n-butyl acrylate and β-CEA. Based on total weight of the monomers, styrene may generally be present in an amount from about 1% to about 99%, including from about 50% to about 95%, and from about 70% to about 90%, although it may be present in greater or lesser amounts; alkyl acrylate such as n-butyl acrylate may generally be present in an amount from about 1% to about 99%, including from about 5% to about 50%, and from about 10% to about 30%, although it may be present in greater or lesser amounts.

Any suitable surfactants may be used for the preparation of latex, wax dispersions, and colorant dispersions according to the present disclosure. Depending on the emulsion system, any desired nonionic or ionic surfactant such as anionic or cationic surfactant may be contemplated. Examples of suitable anionic surfactants include, but are not limited to, sodium dodecylsulfate, sodium dodecylbenzene sulfonate, sodium dodecylnaphthalenesulfate, dialkyl benzenealkyl sulfates and sulfonates, abitic acid, NEOGEN R® and NEOGEN SC® available from Kao, Tayca Power®, available from Tayca Corp., DOWFAX®, available from Dow Chemical Co., and the like, as well as mixtures thereof. Anionic surfactants may be employed in any desired or effective amount, generally at least about 0.01 percent by weight of total monomers used to prepare the latex polymer, and typically at least about 0.1 percent by weight of total monomers used to prepare the latex polymer, and generally no more than about 10 percent by weight of total monomers used to prepare the latex polymer, and typically no more than about 5 percent by weight of total monomers used to prepare the latex polymer, although the amount can be outside of these ranges.

Examples of suitable cationic surfactants include, but are not limited to, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, and $C_{17}$ trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride, available from Kao Chemicals), and the like, as well as mixtures thereof.

Examples of suitable nonionic surfactants include, but are not limited to, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy)ethanol (available from Rhone-Poulenc as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890® (and ANTAROX 897®), and the like, as well as mixtures thereof.

Any suitable initiator or mixture of initiators may be selected in the latex process and the toner process according to the present disclosure. In typical embodiments, the initiator is selected from various known free radical polymerization initiators. The free radical initiator can be any free radical polymerization initiator capable of initiating a free radical polymerization process, and mixtures thereof, typically free radical initiators capable of providing free radical species upon heating to above about 30° C.

Although water soluble free radical initiators that are traditionally used in emulsion polymerization reactions are typically selected, it is also within the scope of the present disclosure that other free radical initiators are employed. Examples of suitable free radical initiators include, but are not limited to, peroxides such as ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate, tetralin hydroperoxide, 1-phenyl-2-methylpropyl-1-hydrop-eroxide, tert-butylhydroperoxide pertriphenylacetate, tert-butyl performate, tert-butyl peracetate, tert-butyl perbenzoate, tert-butyl perphenylacetate, tert-butyl permethoxyacetate, and tert-butyl per-N-(3-toluyl)carbamate; azo compounds such as 2,2'-azobispropane, 2,2'-dichloro-2,2'-azobispropane, 1,1'-azo(methylethyl)diacetate, 2,2'-azobis(2-amidinopropane) hydrochloride, 2,2'-azobis(2-amidinopropane)-nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'- azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonod-initrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1'-azobis-1,2-diphenylethane, poly(bisphenol A-4,4'-azobis-4-cyanopentano-ate), and poly(tetraethylene glycol-2,2'-azobisisobutyrate); and 1,4-bis(pentaethylene)-2-tetrazene, and 1,4-dimethoxycarbonyl-1,4-dipheny-l-2-tetrazene; and the like; and the mixture thereof.

More typical free radical initiators include, but are not limited to, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate and the like.

Based on total weight of the monomers to be polymerized, the initiator may generally be present in an amount from about 0.1% to about 5%, including from about 0.4% to about 4%, and from about 0.5% to about 3%, although it may be present in greater or lesser amounts.

As indicated above, a chain transfer agent may optionally be used to control the polymerization degree of the latex, and thereby control the molecular weight and molecular weight distribution of the product latexes of the latex process and/or the toner process according to the present disclosure. As a skilled artisan can appreciate, typically, the chain transfer agent becomes part of the latex polymer.

In exemplary embodiments, the chain transfer agent has a carbon-sulfur covalent bond. The carbon-sulfur covalent bond has usually absorption peak in a wave number region ranging from 500 to 800 $cm^{-1}$ in an infrared absorption spectrum. When the chain transfer agent is incorporated into the latex and the toner made from the latex, the absorption peak may be changed, for example, to a wave number region of 400 to 4,000 $cm^{-1}$.

Exemplary chain transfer agents include, but are not limited to, n-$C_{3-15}$ alkylmercaptans such as n-propylmercaptan, n-butylmercaptan, n-amylmercaptan, n-hexylmercaptan, n-heptylmercaptan, n-octylmercaptan, n-nonylmercaptan, n-decylmercaptan, and n-dodecylmercaptan; branched alkylmercaptans such as isopropylmercaptan, isobutylmercaptan, s-butylmercaptan, tert-butylmercaptan, cyclohexylmercaptan, tert-hexadecylmercaptan, tert-laurylmercaptan, tert-nonylmercaptan, tert-octylmercaptan, and tert-tetradecylmercaptan; aromatic ring-containing mercaptans such as allylmercaptan, 3-phenylpropylmercaptan, phenylmercaptan, and mercaptotriphenylmethane. As a skilled artisan understands, the term -mercaptan and -thiol may be used interchangeably to mean C—SH group.

Typical examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide, and the like. Dodecanethiol and carbon tetrabromide are most typically used.

Based on total weight of the monomers to be polymerized, the chain transfer agent may generally be present in an amount from about 0.1% to about 7%, including from about 0.5% to about 6%, and from about 1.0% to about 5%, although it may be present in greater or lesser amounts.

In various embodiments, a branching agent may optionally be included in the first/second monomer composition to control the branching structure of the target latex. Exemplary branching agents include, but are not limited to, decanediol diacrylate (ADOD), trimethylolpropane, pentaerythritol, trimellitic acid, pyromellitic acid, and mixtures thereof. In a specific embodiment, the branching agent is ADOD, which may be commercially available from Shin-Najamura Co., Japan.

Based on total weight of the monomers to be polymerized, the branching agent may generally be present in an amount from about 0% to about 2%, including from about 0.05% to about 1.0%, and from about 0.1% to about 0.8%, although it may be present in greater or lesser amounts.

In the latex process and toner process of the disclosure, emulsification may be done by any suitable process such as mixing at elevated temperature. For example, the emulsion mixture may be mixed in a homogenizer set at about 200 to about 400 rpm and at a temperature of from about 40° C. to about 80° C. for a period of from about 1 minute to about 20 minutes.

Any type of reactor may be suitably used without restriction. The reactor should include means for stirring the compositions therein. Typically, the reactor includes at least one impeller. For forming the latex and/or toner, the reactor is preferably operated throughout the process such that the impellers can operate at an effective mixing rate of about 10 to about 1,000 rpm. For example, an effective mixing rate for a 5,000 gallon reactor may be about 35 rpm whereas an effective mixing rate for a 2 Liter size reactor may be about 500 rpm.

Following completion of the monomer addition, the latex may be permitted to stabilize by maintaining the conditions for a period of time, for example for about 10 to about 300 minutes, before cooling. Optionally, the latex formed by the above process may be isolated by standard methods known in the art, for example, coagulation, dissolution and precipitation, filtration, washing, drying, or the like.

The latex having weight average molecular weight of from about $12\times10^3$ to about $25\times10^3$ may be selected for emulsion/aggregation/coalescence processes for forming toners, inks and developers by known methods. As described above, the present disclosure also provides a toner process comprising (a) preparing a latex seed comprising a first monomer composition, an initiator and an optional chain transfer agent by emulsion polymerization; (b) feeding a second monomer composition to the latex seed under monomer-starved polymerization condition to form a latex having weight average molecular weight of from about $12\times10^3$ to about $25\times10^3$; and (c) mixing the latex with a colorant dispersion, a wax dispersion, and a coagulant.

The latex having weight average molecular weight of from about $12\times10^3$ to about $25\times10^3$ may be melt blended or otherwise mixed with various toner ingredients such as a colorant dispersion, a wax dispersion, a coagulant, an optional silica, an optional charge enhancing additive or charge control additive, an optional surfactant, an optional emulsifier, an optional flow additive, and the like. Optionally, the latex (e.g. around 40 percent solids) may be diluted to the desired solids loading (e.g. around 12 to 15 percent by weight solids), before it is formulated into the toner composition.

Based on the total toner weight, the latex having weight average molecular weight of from about $12\times10^3$ to about $25\times10^3$ may generally be present in an amount from about 50% to about 100%, including from about 60% to about 98%, and from about 70% to about 95%, although it may be present in greater or lesser amounts.

Any desired colorant may be employed to the toner process according to the present disclosure. Examples of suitable colorants include dyes and pigments, such as carbon black (for example, REGAL 330®), magnetites, phthalocyanines, HELIOGEN BLUE L6900, D6840, D7080, D7020, PYLAM OIL BLUE, PYLAM OIL YELLOW, and PIGMENT BLUE 1, all available from Paul Uhlich & Co., PIGMENT VIOLET 1, PIGMENT RED 48, LEMON CHROME YELLOW DCC 1026, E.D. TOLUIDINE RED, and BON RED C, all available from Dominion Color Co., NOVAPERM YELLOW FGL and HOSTAPERM PINK E, available from Hoechst, CINQUASIA MAGENTA, available from E.I. DuPont de Nemours & Company, 2,9-dimethyl-substituted quinacridone and anthraquinone dyes identified in the Color Index as CI 60710, CI Dispersed Red 15, diazo dyes identified in the Color Index as CI 26050, CI Solvent Red 19, copper tetra (octadecyl sulfonamido)phthalocyanine, x-copper phthalocyanine pigment listed in the Color Index as CI 74160, CI Pigment Blue, Anthrathrene Blue, identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Permanent Yellow FGL, Pigment Yellow 74, B 15:3 cyan pigment dispersion, commercially available from Sun Chemicals, Magenta Red 81:3 pigment dispersion, commercially available from Sun Chemicals, Yellow 180 pigment dispersion, commercially available from Sun Chemicals, colored magnetites, such as mixtures of MAPICO BLACK® and cyan components, and the like, as well as mixtures thereof. Other commercial sources of pigments available as aqueous pigment dispersion from either Sun Chemical or Ciba include (but are not limited to) Pigment Yellow 17, Pigment Yellow 14, Pigment Yellow 93, Yellow Pigment PY74, Pigment Violet 23, Pigment Violet 1, Pigment Green 7, Pigment Orange 36, Pigment Orange 21, Pigment Orange 16, Pigment Red 185, Pigment Red 122, Pigment Red 81:3, Pigment Blue 15:3, and Pigment Blue 61, and other pigments that enable reproduction of the maximum Pantone color space. Mixtures of colorants can also be employed.

In specific embodiments, the colorant used in the toner process is selected from the group consisting of Pigment Blue 15:3, Yellow Pigment PY74, Black Pigment REGAL 330, Red Pigment PR122, and mixture thereof.

Based on the total toner weight, the colorant or colorant mixture may generally be present in an amount from about 0% to about 30%, including from about 1% to about 25%, and from about 2% to about 20%, although it may be present in greater or lesser amounts.

Various examples of wax include, but are not limited to, Fischer-Tropsch wax (by coal gasification); vegetable waxes such as carnauba wax, Japan wax, Bayberry wax, rice wax, sugar cane wax, candelilla wax, tallow, and jojoba oil; animal wax such as beeswax, Shellac wax, Spermaceti wax, whale wax, Chinese wax, and lanolin; ester wax; saturated fatty acid amides wax such as capronamide, caprylamide, pelargonic amide, capric amide, laurylamide, tridecanoic amide, myristylamide, stearamide, behenic amide, and ethylene-bis-stearamide; unsaturated fatty acid amides wax such as caproleic amide, myristoleic amide, oleamide, elaidic amide, linoleic amide, erucamide, ricinoleic amide, and linolenic amide; mineral waxes such as montan wax, ozokerite, ceresin, and lignite wax; petroleum waxes such as paraffin wax and microcrystalline wax; polyolefin waxes such as low-molecular polyethylene, low-molecular polypropylene, and low-molecular polybutene; synthetic waxes such as polytetrafluoroethylene wax, Akura wax, and distearyl ketone; hydrogenated waxes such as castor wax and opal wax; and modified waxes such as montan wax derivatives, paraffin wax derivatives, and microcrystalline wax derivatives, and combinations thereof.

Examples of waxes or wax emulsions that are commercially available include those available from Allied Chemical and Petrolite Corporation, Michaelman Inc, the Daniels Products Company, and the Genesee Polymers Corporation. Wax emulsions are typically prepared as dispersions of a wax in water, which dispersion is comprised of a wax, and a dispersant such as a nonionic, ionic or a mixture of surfactants. A specific example of wax is POLYWAX 725 wax emulsion (polyethylene wax, 30 percent active, Baker Petrolite).

Based on the total toner weight, the wax or wax mixture may generally be present in an amount from about 0% to about 30%, including from about 2% to about 25%, and from about 4% to about 20%, although it may be present in greater or lesser amounts.

Examples of coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like.

A very typical coagulant is PAC which is commercially available, and can be prepared by the controlled hydrolysis of aluminum chloride with sodium hydroxide. Generally, the PAC can be prepared by the addition of two moles of a base to one mole of aluminum chloride. The species is soluble and stable when dissolved and stored under acidic conditions if the pH is less than 5. The species in solution is believed to be of the formula $Al_{13}O_4(OH)_{24}(H_2O)_{12}$ with 7 positive electrical charges per unit.

Based on the total toner weight, the coagulant or coagulant mixture may generally be present in an amount from about 0.01% to about 1.0%, including from about 0.05% to about 0.5%, and from about 0.1% to about 0.4%, although it may be present in greater or lesser amounts.

Optionally, silica may be added as an internal silica additive. For example, silica can be mixed with the colorant, the wax, and the coagulant. Internally, silica can be added with pigment, resin, etc., and functions to aid in release from the fuser roll, as well as to increase gloss of the fused image.

Suitable silica may be colloidal silica particles, i.e., silica particles having a volume average particle size, for example as measured by any suitable technique such as by using a Coulter Counter, of from about 5 nm to about 200 nm in an aqueous colloidal dispersion. The colloidal silica dispersion may contain, for example, about 2% to about 30% solids, and generally from about 2% to about 20% solids.

In an exemplary embodiment, the colloidal silica particles may have a bimodal average particle size distribution. Specifically, the colloidal silica particles comprise a first population of colloidal silica particles having a volume average particle size of from about 5 to about 200 nm, and generally from about 5 nm to about 100 nm, and a second population of colloidal silica particles having a volume average particle size of about 5 to about 200 nm, and generally about 5 to about 100 nm, although the particle size can be outside of these ranges. The first group of colloidal silica particles may comprise, e.g., SNOWTEX OS supplied by Nissan Chemical Industries (about 8 nm), while the second group of colloidal silica particles may comprise, e.g., SNOWTEX OL supplied by Nissan Chemical Industries (about 40 nm).

It is believed that the smaller sized colloidal silica particles are beneficial for toner gloss, while the larger sized colloidal silica particles are beneficial for toner release properties. Therefore the toner release properties and the toner gloss may be controlled by varying the ratio of differently sized colloidal silica particles.

Other properties of silica to be added should be suitable for, or at least not detrimental to, the toner process of the present discovery. For example, the aqueous dispersion of Snowtex OL colloidal silica has such properties as 20-21 wt % of $SiO_2$, less than 0.04% of flammable alkali (as $Na_2O$), 2-4 of pH value, spherical particle shape, 40-50 nm particle size, <3 mPa·s. Viscosity at 25° C., 1.12-1.14 specific gravity at 25° C., and opalescent appearance.

Based on the total toner weight, silica may generally be present in an amount from about 0% to about 30%, including from about 1% to about 20%, and from about 2% to about 10%, although it may be present outside the ranges. In case the silica contains a first group of colloidal silica and a second group of colloidal silica, the first group of colloidal silica particles are present in an amount of from about 0.0% to about 15%, and generally about 0.0% to about 10%, of the total amount of silica; and the second group of colloidal silica particles are present in an amount of from about 0.0% to about 15%, and generally about 0.0% to about 10%, of the total amount of silica.

Various known suitable and effective positive/negative charge enhancing additives can be selected for incorporation into the toner formulation. Examples include quaternary ammonium compounds inclusive of alkyl pyridinium halides; alkyl pyridinium compounds, reference U.S. Pat. No. 4,298,672, the disclosure of which is totally incorporated herein by reference; organic sulfate and sulfonate compositions, U.S. Pat. No. 4,338,390, the disclosure of which is totally incorporated herein by reference; cetyl pyridinium tetrafluoroborates; distearyl dimethyl ammonium methyl sulfate; aluminum salts such as BONTRON E84 or E88 (Hodogaya Chemical); and the like.

Based on the total toner weight, charge enhancing additive may generally be present in an amount from about 0% to about 10%, including from about 0.5% to about 6 and from about 1.0% to about 4.0%, although it may be present outside the ranges.

In specific embodiments, the latex process and the toner process of the disclosure provide a modification with better reproducibility to the standard process currently employed to make latex for Imari-MF toners, as described in some of the prior Xerox patents listed in the background section. The latex process is a process to manufacture latex with a lower molecular weight, Mw, than is used in Imari-MF formulations, to provide higher gloss to the printed image. The latex product may be beneficially used for high gloss applications in belt fuser operations.

The present disclosure provides a toner, which is prepared from a toner formulation comprising a latex having weight average molecular weight of from about $12\times10^3$ to about $25\times10^3$, a colorant dispersion, a wax dispersion, and a coagulant. Optionally, the toner composition comprises silica, a charge enhancing additive or charge control additive, a surfactant, an emulsifier, a flow additive, and the mixture thereof.

In various embodiments, the latex having weight average molecular weight of from about $12\times10^3$ to about $25\times10^3$ is prepared by the latex process as described above.

In various embodiments, the toner is prepared from the toner formulation by the toner process as described above.

In a specific embodiment, the latex is aggregated with the appropriate amounts of colorant such as pigment (5 to 7% depending on pigment) and the standard polyethylene wax, Polywax 725 (9% of toner) using the flocculent poly(aluminum chloride) PAC at 0.12 pph loading.

In embodiments, the toner of the present disclosure may produce a fused image that has a gloss generally at least about 8 gloss units higher, typically at least about 12 gloss units higher, and more typically at least about 15 gloss units higher, than prior art EA toners prepared from a formulation comprising a latex having a weight average molecular weight higher than about $25\times10^3$ for example, mainline EA latex with a weight average molecular weight of $33\times10^3$ to $35\times10^3$ for Imari-MF.

Gloss is a subjective term used to describe the relative amount and nature of mirror like (specular) reflection. Different types of gloss are frequently arbitrarily differentiated, such as sheen, distinctness-of-image gloss, etc. Gloss value may be the numerical value for the amount of specular reflection relative to that of a standard surface under the same geometric conditions. Because the gloss of a specimen can vary greatly with the angle of observation, it has been standardized on angles of 20°, 60°, 75°, and 85° degrees to the normal for its measurement. Gloss measured at an angle of 85° is commonly referred to as sheen.

In the embodiments of the present discovery, gloss units refer to the number obtained by measuring the fused image using a Gardner Gloss metering unit set to a measurement angle of 75°.

In a specific embodiment, the toner can produce high gloss images that were obtained on two different belt fuser designs, either a low oil belt fuser subsystem, or an oil-less fuser design such as the free belt nip fuser (FBNF) currently used in Imari-MF family products.

Toners of the disclosure can be used in known electrostatographic imaging methods. Thus, for example, the toners can be charged, e.g., triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

As used herein, the following characteristics are defined as follows:

A. Minimum Fixing Temperature

The Minimum Fixing Temperature (MFT) measurement involves folding an image fused at a specific temperature, and rolling a standard weight across the fold. The folded image is then unfolded and analyzed under the microscope and assessed a numerical grade based on the amount of crease showing in the fold. This procedure is repeated at various temperatures until the minimum fusing temperature (showing very little crease) is obtained.

B. Stripping Force

Stripping Force was evaluated as follows. A number of unfused toner images, each consisting of two five centimeter (cm) by four cm solid area rectangles separated by a distance of one cm, were developed onto paper sheets with a paper weight of between 50 and 55 grams/square meter. Unfused images can be produced, for example, by copying or printing the image described above using a desktop xerographic copier or printer from which the fuser has been removed. Moreover, the xerographic developer for the desktop copier or printer has been replaced with a developer comprised of the toner particles to be evaluated for stripping force, and a suitable xerographic carrier. The toner images are produced with a toner mass per unit area of 1.25 milligrams/square centimeter. The paper sheets with unfused toner images are then passed, one at a time, through a two roll fuser system which has been equipped with a stripper finger in close proximity to the surface of the heat roll which contacts the unfused image, such that the stripper finger contacts the paper sheet as it exits the fuser nip, and passes along the one cm gap between the two rectangular toner images. The stripper finger is equipped with a strain gauge which measures the force exerted on the stripper finger by the paper sheet as it exits the fuser nip, which is a measure of the adhesive force between the fused toner image and the heat roll as it is stripped from the roll. The maximum force exerted on the stripper finger during the passage of the toner image through the fuser is recorded as the Stripping Force. The Stripping Force is measured for fusing temperatures between about 140° C. and 180° C. A maximum Stripping Force of less than 25 grams force is considered acceptable.

C. Gloss

Print gloss (Gardner gloss units or "ggu") was measured using a 75° BYK Gardner gloss meter for toner images that had been fused at a fuser roll temperature range of about 120° C. to about 210° C. (sample gloss is dependent on the toner, the toner mass per unit area, the paper substrate, the fuser roll, and fuser roll temperature).

D. Document Offset

A standard document offset mapping procedure was performed as follows. Five centimeter (cm) by five cm test samples were cut from the prints taking care that when the sheets are placed face to face, they provide both toner to toner and toner to paper contact. A sandwich of toner to toner and toner to paper was placed on a clean glass plate. A glass slide was placed on the top of the samples and then a weight comprising a 2000 gram mass was placed on top of the glass slide. The glass plate was then inserted into an environmental chamber at a temperature of 60° C. where the relative humidity was kept constant at 50%. After 7 days, the samples were removed from the chamber and allowed to cool to room temperature before the weight was removed. The removed samples were then carefully peeled apart. The peeled samples were mounted onto a sample sheet and then visually rated with a Document Offset Grade from 5.0 to 1.0, wherein a lower grade indicates progressively more toner offset, ranging from none (5.0) to severe (1.0). Grade 5.0 indicates no toner offset and no adhesion of one sheet to the other. Grade 4.5 indicates noticeable adhesion, but no toner offset. Grade 4 indicates that a very small amount of toner offsets to the other sheet. Grade 3 indicates that less than ⅓ of the toner image offsets to the other sheet, while Grade 1.0 indicates that more than ½ of the toner image offsets to the other sheet. In general, an evaluation of greater than or equal to 3.0 is considered necessary, and an evaluation of greater than or equal to 4.0 is desirable.

E. Vinyl Offset

Vinyl offset was evaluated as follows. Toner images were covered with a piece of standard vinyl (32% dioctyl phthalate Plasticizer), placed between glass plates, loaded with a 250 gram weight, and placed in an environmental oven at a pressure of 10 g/cm$^2$, 50° C. and 50% RH. After 24 hours, the samples were removed from the oven and allowed to cool to room temperature. The vinyl and toner image were carefully peeled apart, and evaluated with reference to a vinyl offset evaluation rating procedure as described above for document offset wherein Grades 5.0 to 1.0 indicate progressively higher amounts of toner offset onto the vinyl, from none (5.0) to severe (1.0). Grade 5.0 indicates no visible toner offset onto the vinyl and no disruption of the image gloss. Grade 4.5 indicates no toner offset, but some disruption of image gloss. An evaluation of greater than or equal to 4.0 is considered an acceptable grade.

F. Charging

For the evaluation of toner particles in Examples 10, 11, 12, and 13, the parent charge was measured by conditioning the toner at 5% TC (Toner Concentration) with standard 35 micron Xerox DocuColor. 2240 carrier, in both A-zone and C-zone overnight, followed by charge evaluation after either 2 minutes or 60 minutes of mixing on a Turbula mixer. The results are presented in FIG. 15. Humidity sensitivity is an important charging property for EA toners. The charging performance was tested in two environmental chambers, one is a low-humidity zone (also known as the C-zone), while another one is a high humidity zone (also known as the A-zone). The C-zone had a 15% relative humidity (RH) at an operating temperature of 10° C., and the A-zone had a 85% relative humidity at an operating temperature of 28° C. The quantity of charge is a value measured through image analysis of the charge-spectrograph process (CSG). Toner charge-to-diameter ratios (q/d) in C- and A-zones, typically with a unit of femtocoulombs/micron(mm), were measured on a known standard charge spectrograph.

Specific embodiments of the disclosure will now be described in detail. These examples are intended to be illustrative, and the disclosure is not limited to the materials, conditions, or process parameters set forth in these embodiments. All parts and percentages are by weight unless otherwise indicated.

EXAMPLES

Example 1

Preparation of S/nBA EA Toner GW-T1 Containing 9% Polywax 725

Step 1: Preparation of Latex GW-L1

A latex emulsion comprised of polymer particles generated from the emulsion polymerization of styrene, n-butyl acrylate and beta-CEA was prepared as follows. A surfactant solution consisting of 607 grams Dowfax 2A1 (anionic emulsifier) and 387 kg de-ionized water was prepared by mixing for 10 minutes in a stainless steel holding tank. The holding tank was then purged with nitrogen for 5 minutes before transferring into the reactor. The reactor was then continuously purged with nitrogen while being stirred at 100 RPM. The reactor was then heated up to 80° C. at a controlled rate to 80° C., and held there. Separately 6.1 kg of ammonium persulfate initiator was dissolved in 30.2 kg of de-ionized water. Separately the monomer emulsion was prepared in the following manner. 315 kg of styrene, 92 kg of butyl acrylate and 12.2 kg of β-CEA, 7.0 kg of 1-dodecanethiol, 1.4 kg of ADOD, 8.6 kg of Dowfax 2A1 (anionic surfactant), and 193 kg of deionized water were mixed to form an emulsion. 5% of the above emulsion is then slowly fed into the reactor containing the aqueous surfactant phase at 80° C. to form the "seeds" while being purged with nitrogen. The initiator solution is then slowly charged into the reactor and after 10 minutes the rest of the emulsion is continuously fed in a using metering pump at a rate of 0.5%/min. Once all the monomer emulsion is charged into the main reactor, the temperature is held at 80° C. for an additional 2 hours to complete the reaction. Full cooling is then applied and the reactor temperature is reduced to 35° C. The product is collected into a holding tank. After drying the latex the molecular properties were Mw=34,800 Mn=11,000 and the onset Tg was 50.6° C.

Step 2: Preparation of EA Toner Particles GW-T1 from Latex GW-L1 Containing 9% Polywax 725

Into a 4 liter glass reactor equipped with an overhead stirrer and heating mantle was dispersed 254.9 grams of the above latex GW-L1 having a 41.93 percent solids content, 50.50 grams of Polywax 725 dispersion having a solids content of 32.88 percent, 44.79 grams of a Blue Pigment PB15:3 dispersion having a solids content of 21.90 percent into 582.1 grams of water with high shear stirring by means of a polytron. To this mixture was added 21.6 grams of a coagulant solution consisting of 10 weight percent poly(aluminium-chloride), PAC and 90 wt. % 0.02M $HNO_3$ solution. The PAC solution was added drop-wise at low rpm and as the viscosity of the pigmented latex mixture increased the rpm of the polytron probe also increased to 5,000 rpm for a period of 2 minutes. This produced a flocculation or heterocoagulation of gelled particles consisting of nanometer sized latex particles, 9% wax and 5% pigment for the core of the particles. The pigmented latex/wax slurry was heated at a controlled rate of 0.5° C./minute up to approximately 52° C. and held at this temperature or slightly higher to grow the particles to approximately 5.0 microns. Once the average particle size of 5.0 microns was achieved, 123.06 grams of the latex GW-L1 was then introduced into the reactor while stirring. After an additional 30 minutes to 1 hour the particle size measured was 5.7 microns with a GSD of 1.20. The pH of the resulting mixture was then adjusted from 2.0 to 7.0 with aqueous base solution of 4 percent sodium hydroxide and allowed to stir for an additional 15 minutes. Subsequently, the resulting mixture was heated to 93° C. at 1.0° C. per minute and the particle size measured was 5.98 microns with a GSD by volume of 1.22 and GSD by number of 1.22. The pH was then reduced to 4.3 using a 2.5 percent Nitric acid solution. The resultant mixture was then allowed to coalesce for 5 hrs at a temperature of 93° C. The morphology of the particles was smooth and "potato" shape. The final particle size after cooling but before washing was 5.98 microns with a GSD by volume of 1.21. The particles were washed 6 times, where the $1^{st}$ wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.64 microns with $GSD_V$=1.20 and $GSD_n$=1.23. The glass transition temperature of this sample was measured by DSC and found to have Tg(onset)=49.4° C.

The particles were dried blended with the standard Imari-MF 5 additive package consisting of 1.37% RY50, 0.88% JMT2000, 1.78% X-24, 0.6% EAWZn and 0.6% U-ADD to produce a free flowing toner. Then 805 grams of developer was prepared using 76.5 grams of this toner and 773.5 grams of 35 micron SK276 carrier. The developer was evaluated in a belt fuser. 2.1 RAM system operating at a print speed of 60 PPM and fusing speed of 80 PPM.

Example 2

Preparation of S/nBA EA Toner GW-T2 Containing 9% Polywax 725

Step 1: Preparation of Latex GW-L2

A latex emulsion comprised of polymer particles generated from the semi-continuous emulsion polymerization of styrene, n-butyl acrylate and beta-CEA was prepared as follows. The procedure given below is for the 2L scale reaction. A surfactant solution consisting of 0.9 grams Dowfax 2A1 (anionic emulsifier) and 514 grams de-ionized water was prepared by mixing for 10 minutes in a stainless steel holding tank. The holding tank was then purged with nitrogen for 5 minutes before transferring into the reactor. The reactor was then continuously purged with nitrogen while being stirred at 300 RPM. The reactor was then heated up to 76° C. at a controlled rate and held constant. In a separate container, 8.1 grams of ammonium persulfate initiator was dissolved in 45 grams of de-ionized water. Also in a second separate container, the monomer emulsion was prepared in the following manner. 418.5 grams of styrene, 121.5 grams of n-butyl acrylate and 16.2 grams of β-CEA, 8.1 grams of 1-dodecanethiol, 10.59 grams of Dowfax 2A1 (anionic surfactant), and 257 grams of deionized water were mixed to form an emulsion. The ratio of styrene monomer to n-butyl acrylate monomer by weight was 77.5 to 22.5 percent. One percent of the above emulsion is then slowly fed into the reactor containing the aqueous surfactant phase at 76° C. to form the "seeds" while being purged with nitrogen. The initiator solution is then slowly charged into the reactor and after 20 minutes the rest of the emulsion is continuously fed in using metering pumps at a rate of 0.5%/min. Once all the monomer emulsion is charged into the main reactor, the temperature is held at 76° C. for an additional 2 hours to complete the reaction. Full cooling is then applied and the reactor temperature is reduced to 35° C. The product is collected into a holding tank after filtration through a 1 micron filter bag. After drying a portion of the latex, the molecular properties were measured to be Mw=23,500, Mn=10,900 and the onset Tg was 51.4° C. The average particle size of the latex as measured by Disc Centrifuge was 200 nanometers and residual monomer as measured by GC as <50 ppm for styrene and <100 ppm for n-butyl acrylate. This latex was used to prepare EA toner particles GW-T2 as described below.

Step 2: Preparation of EA Toner Particles GW-T2 from Latex GW-L2 Containing 9% Polywax 725

Into a 4 liter glass reactor equipped with an overhead stirrer and heating mantle was dispersed 254.9 grams of the above latex GW-L2 having a 41.21 percent solids content, 50.50 grams of Polywax 725 dispersion having a solids content of 32.88 percent, 44.79 grams of a Blue Pigment PB15:3 dispersion having a solids content of 21.90 percent into 582.1 grams of water with high shear stirring by means of a polytron. To this mixture was added 21.6 grams of a coagulant solution consisting of 10 weight percent poly(aluminium-chloride), PAC and 90 wt. % 0.02M $HNO_3$ solution. The PAC solution was added drop-wise at low rpm and as the viscosity of the pigmented latex mixture increased the rpm of the polytron probe also increased to 5,000 rpm for a period of 2 minutes. This produced a flocculation or heterocoagulation of gelled particles consisting of nanometer sized latex particles, 9% wax and 5% pigment for the core of the particles. The pigmented latex/wax slurry was heated at a controlled rate of 0.5° C./minute up to approximately 52° C. and held at this temperature or slightly higher to grow the particles to approximately 5.0 microns. Once the average particle size of 5.0 microns was achieved, 125.21 grams of the latex GW-L2 was then introduced into the reactor while stirring. After an additional 30 minutes to 1 hour the particle size measured was 5.2 microns with a GSD of 1.18. The pH of the resulting mixture was then adjusted from 2.0 to 7.0 with aqueous base solution of 4 percent sodium hydroxide and allowed to stir for an additional 15 minutes. Subsequently, the resulting mixture was heated to 93° C. at 1.0° C. per minute and the particle size measured was 5.2 microns with a GSD by volume of 1.18 and GSD by number of 1.22. The pH was then reduced to 4.3 using a 2.5 percent Nitric acid solution. The resultant mixture was then allowed to coalesce for 5 hrs at a temperature of 93° C. The morphology of the particles was smooth and "potato" shape. The final particle size after cooling but before washing was 5.20 microns with a GSD by volume of 1.21. The particles were washed 6 times, where the 1$^{st}$ wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.21 microns with $GSD_v$=1.18 and $GSD_n$=1.21. The glass transition temperature of this sample was measured by DSC and found to have Tg(onset)=49.8° C.

The particles were dried blended with the standard Imari-MF 5 additive package consisting of 1.37% RY50, 0.88% JMT2000, 1.78% X-24, 0.6% EAWZn and 0.6% U-ADD to produce a free flowing toner. Then 805 grams of developer was prepared using 76.5 grams of this toner and 773.5 grams of 35 micron SK276 carrier. The developer was evaluated in a belt fuser. 2.1 RAM system operating at a print speed of 60 PPM and fusing speed of 80 PPM.

Example 3

Preparation of S/nBA EA Toner GW-T3 Containing 9% Polywax 725

Step 1: Preparation of Latex GW-L3

A latex emulsion comprised of polymer particles generated from the semi-continuous emulsion polymerization of styrene, n-butyl acrylate and beta-CEA was prepared as follows. The procedure given below is for the 2L scale reaction. A surfactant solution consisting of 0.8 grams Dowfax 2A1 (anionic emulsifier) and 514 grams de-ionized water was prepared by mixing for 10 minutes in a stainless steel holding tank. The holding tank was then purged with nitrogen for 5 minutes before transferring into the reactor. The reactor was then continuously purged with nitrogen while being stirred at 300 RPM. The reactor was then heated up to 76° C. at a controlled rate and held constant. In a separate container, 8.1 grams of ammonium persulfate initiator was dissolved in 45 grams of de-ionized water. Also in a second separate container, the monomer emulsion was prepared in the following manner. 445.5 grams of styrene, 94.5 grams of n-butyl acrylate and 16.2 grams of β-CEA, 16.2 grams of 1-dodecanethiol, 10.69 grams of Dowfax (anionic surfactant), and 257 grams of deionized water were mixed to form an emulsion. The ratio of styrene monomer to n-butyl acrylate monomer by weight was 82.5 to 17.5 percent. One percent of the above emulsion is then slowly fed into the reactor containing the aqueous surfactant phase at 76° C. to form the "seeds" while being purged with nitrogen. The initiator solution is then slowly charged into the reactor and after 20 minutes the rest of the emulsion is continuously fed in using metering pumps at a rate of 0.374%/min. Once all the monomer emulsion is charged into the main reactor, the temperature is held at 76° C. for an additional 2 hours to complete the reaction. Full cooling is then applied and the reactor temperature is reduced to 35° C. The product is collected into a holding tank after filtration through a 1 micron filter bag. After drying a portion of the latex the molecular properties were measured to be Mw=12,739, Mn=6,208 and the onset Tg was 50.0° C. The average particle size of the latex as measured by Disc Centrifuge was 220 nanometers and residual monomer as measured by GC as <50 ppm for styrene and <100 ppm for n-butyl acrylate. This latex was used to prepare EA toner particles GW-T3 as described below.

Step 2: Preparation of EA Toner Particles GW-T3 from Latex GW-L3 Containing 9% Polywax 725

Into a 4 liter glass reactor equipped with an overhead stirrer and heating mantle was dispersed 258.5 grams of the above latex GW-L3 having a 41.35 percent solids content, 50.50 grams of Polywax 725 dispersion having a solids content of 32.88 percent, 44.79 grams of a Blue Pigment PB15:3 dispersion having a solids content of 21.90 percent into 582.1 grams of water with high shear stirring by means of a polytron. To this mixture was added 21.6 grams of a coagulant solution consisting of 10 weight percent poly(aluminium-chloride), PAC and 90 wt. % 0.02M $HNO_3$ solution. The PAC solution was added drop-wise at low rpm and as the viscosity of the pigmented latex mixture increased the rpm of the polytron probe also increased to 5,000 rpm for a period of 2 minutes. This produced a flocculation or heterocoagulation of gelled particles consisting of nanometer sized latex particles, 9% wax and 5% pigment for the core of the particles. The pigmented latex/wax slurry was heated at a controlled rate of 0.5° C./minute up to approximately 52° C. and held at this temperature or slightly higher to grow the particles to approximately 5.0 microns. Once the average particle size of 5.0 microns was achieved, 124.79 grams of the latex GW-L3 was then introduced into the reactor while stirring. After an additional 30 minutes to 1 hour the particle size measured was 5.49 microns with a GSD of 1.20. The pH of the resulting mixture was then adjusted from 2.0 to 7.0 with aqueous base solution of 4 percent sodium hydroxide and allowed to stir for an additional 15 minutes. Subsequently, the resulting mixture was heated to 93° C. at 1.0° C. per minute and the particle size measured was 5.61 microns with a GSD by volume of 1.22 and GSD by number of 1.24. The pH was then reduced to 4.3 using a 2.5 percent Nitric acid solution. The resultant mixture was then allowed to coalesce for 5 hrs at a temperature of 93° C. The morphology of the particles was smooth and "potato" shape. The final particle size after cooling but before washing was 5.34 microns with a GSD by volume of 1.25. The particles were washed 6 times, where the 1$^{st}$ wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.34 microns with $GSD_v$=1.25 and GSDn=1.21. The glass transition temperature of this sample was measured by DSC and found to have Tg(onset)=49.4° C.

The particles were dried blended with the standard Imari-MF 5 additive package consisting of 1.37% RY50, 0.88% JMT2000, 1.78% X-24, 0.6% EAWZn and 0.6% U-ADD to produce a free flowing toner. Then 805 grams of developer was prepared using 76.5 grams of this toner and 773.5 grams of 35 micron SK276 carrier. The developer was evaluated in a belt fuser 2.1 RAM system operating at a print speed of 60 PPM and fusing speed of 80 PPM.

These three toners were also repeated using latexes of similar molecular weight but with varying Tg onset. Shown in FIG. 1 is a plot of the 75° gloss of toner images fused on LustroGloss™ paper (LG) in the Sfida Mark 3 Belt Fuser at an External Heat Roll Temperature of 190 degrees Celsius versus latex molecular weight for all these toners. LustroGloss is a 120 grams per square meter (gsm) coated paper produced by the S.D. Warren Co. The raw data is shown in Table 1. Toner Gloss is shown to increase with a decrease in latex molecular weight.

TABLE 1

Raw data of Toner Image Gloss at 190 degrees Fusing Temperature versus toner latex molecular weight for various E/A cyan toners.

| Toner latex Tg = 50 | | Toner latex Tg = 54 | | Toner latex Tg = 45 | |
|---|---|---|---|---|---|
| Mw (/1000) | Gloss @ 190 | Mw (/1000) | Gloss @ 190 | Mw (/1000) | Gloss @ 190 |
| 34.8 | 50 | 32.5 | 40 | 32.2 | 60 |
| 23.5 | 76 | 19.4 | 75 | 17.1 | 93 |
| 12.7 | 95 | 12.6 | 92 | 12.6 | 96 |

Example 4

Preparation of Several S/nBA EA Latexes Using Various Monomer Feed Rates

The following procedure describes the process of making EA latex with low molecular weight (~20,000) for high gloss applications. This procedure was repeated several times with various monomer feed rates to study the effect the feed rate has on the latex properties. Reactions in this example are for the 2L scale. Latexes KNL-7, KNL-8, KNL-9, and KNL-10 were made at the 2L scale. GW-L4, GW-L5, GW-L6, and GW-L7 were made at the 5 gallon scale in which case the amounts required for the example below were adjusted accordingly.

A latex emulsion comprised of polymer particles generated from the semi-continuous emulsion polymerization of styrene, n-butyl acrylate and beta-CEA was prepared as follows. This reaction formulation prepared in a 2 litre Buchi reactor was scale-up first to a 5 gallon scale and then to a 100 gallon scale. The quantities of materials were adjusted accordingly. The procedure given below is for the 2L scale reaction.

A surfactant solution consisting of 0.8 grams Dowfax 2A1 (anionic emulsifier) and 514 grams de-ionized water was prepared by mixing for 10 minutes in a stainless steel holding tank. The holding tank was then purged with nitrogen for 5 minutes before transferring into the reactor. The reactor was then continuously purged with nitrogen while being stirred at 300 RPM. The reactor was then heated up to 76° C. at a controlled rate and held constant. In a separate container, 8.1 grams of ammonium persulfate initiator was dissolved in 45 grams of de-ionized water. Also in a second separate container, the monomer emulsion was prepared in the following manner. 442.8 grams of styrene, 97.2 grams of n-butyl acrylate and 16.2 grams of β-CEA, 11.88 grams of 1-dodecanethiol, 1.89 grams of ADOD, 10.69 grams of Dowfax (anionic surfactant), and 257 grams of deionized water were mixed to form an emulsion. The ratio of styrene monomer to n-butyl acrylate monomer by weight was 82 to 18 percent. One percent of the above emulsion is then slowly fed into the reactor containing the aqueous surfactant phase at 76° C. to form the "seeds" while being purged with nitrogen. The initiator solution is then slowly charged into the reactor and after 20 minutes the rest of the emulsion is continuously fed in using metering pumps at monomer feed rates varying from 0.48-0.57%/minute. Once all the monomer emulsion is charged into the main reactor, the temperature is held at 76° C. for an additional 2 hours to complete the reaction. Full cooling is then applied and the reactor temperature is reduced to 35° C. The product is collected into a holding tank after filtration through a 1 micron filter bag.

Figure 2:
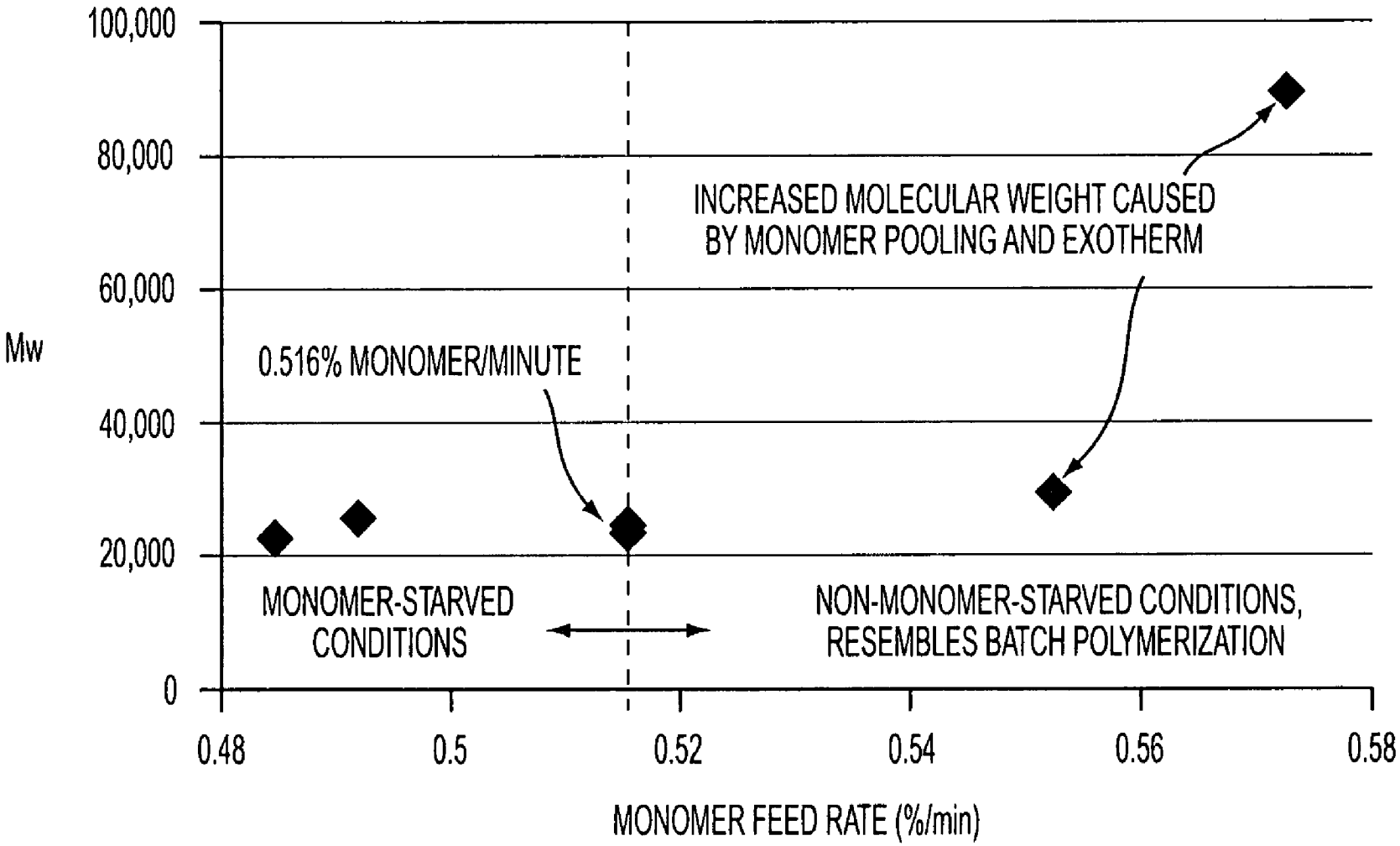
FIG. 2 shows the correlation between molecular weight versus monomer feed rate for various EA latexes to make high gloss toners according to an embodiment of the present disclosure.

After drying a portion of the latex, the molecular properties were measured and are shown in FIG. 2 and Table 2 below. This latex was not used to make EA toner. FIG. 2 shows molecular weight versus monomer feed rate for various EA latexes using a formulation to obtain low (~20,000) molecular weight latex to make high gloss toner.

TABLE 2

Raw Data for various EA latexes to study monomer feed rate

| Latex ID | %/min | Latex Mw | Tg(onset) |
|---|---|---|---|
| KNL-7 | 0.516 | 22,882 | 53.6 |
| KNL-8 | 0.516 | 23,070 | 53.3 |
| KNL-9 | 0.516 | 23,274 | 53.9 |
| KNL-10 | 0.516 | 22,238 | 51.1 |
| GW-L4 | 0.552 | 29,406 | 53.3 |
| GW-L5 | 0.573 | 89,200 | 51.1 |
| GW-L6 | 0.485 | 21,698 | 51.8 |
| GW-L7 | 0.492 | 24,301 | 50.2 |

It was found that a low molecular weight latex could be synthesized using the latex formulation in Example 3 if the monomer feed rate was no greater than 0.516%/minute. Monomer feed rates equal to or less than 0.516% monomer/minute resulted in monomer-starved conditions and the molecular weight was controlled by the concentration of chain transfer agent (DDT). If the monomer feed rate was above 0.516% monomer/minute, this resulted in monomer pooling (excess monomer in which the rate of monomer addition is greater than the rate of monomer consumption in the polymerization), in which case an exotherm would result and the molecular weight would grow at an uncontrolled rate. Under these conditions, the chain transfer agent has little control over molecular weight, and a low molecular weight is unachievable. Low molecular weight latex is helpful in making E/A toner with high gloss fusing properties. Advantageously, the latex can be synthesized using semi-batch monomer-starved emulsion polymerization conditions. Therefore, the latex may be synthesized using a monomer feed rate no greater than 0.516% monomer/minute.

Example 5

Preparation of Latex GW-L8

A latex emulsion comprised of polymer particles generated from the emulsion polymerization of styrene, n-butyl acrylate and beta-CEA was prepared as follows. A surfactant solution consisting of 0.8 grams Dowfax 2A1 (anionic emulsifier) and 514 grams de-ionized water was prepared by mixing for 10 minutes in a stainless steel holding tank. The holding tank was then purged with nitrogen for 5 minutes before transferring into the reactor. The reactor was then continuously purged with nitrogen while being stirred at 300 RPM. The reactor was then heated up to 76° C. at a controlled rate, and held there. Separately 8.1 grams of ammonium persulfate initiator was dissolved in 45 grams of de-ionized water. Separately the monomer emulsion was prepared in the following manner. 442.8 grams of styrene, 97.2 grams of butyl acrylate and 16.2 grams of β-CEA, 11.3 grams of 1-dodecanethiol, 1.89 grams of ADOD, 10.68 grams of Dowfax 2A1 (anionic surfactant), and 256 grams of deionized water were mixed to form an emulsion. 1% of the above emulsion is then slowly fed into the reactor containing the aqueous surfactant phase at 76° C. to form the "seeds" while being purged with nitrogen. The initiator solution is then slowly charged into the reactor and after 10 minutes the rest of the emulsion is continuously fed in a using metering pump at a rate of 0.5%/min. After 100 minutes, half of the monomer emulsion has been added to the reactor, and the reactor stirrer is increased to 350 RPM. Once all the monomer emulsion is charged into the main reactor, the temperature is held at 76° C. for an additional 2 hours to complete the reaction. Full cooling is then applied and the reactor temperature is reduced to 35° C. The product is collected into a holding tank. After drying the latex the molecular properties were Mw=19,200 Mn=8,100 and the onset Tg was 53.2° C.

Example 6

Preparation of EA Cyan Toner Particles GW-T81 from Latex GW-L8 Containing 9% Polywax 725

Into a 2 liter glass reactor equipped with an overhead stirrer and heating mantle was dispersed 283.2 grams of the above latex GW-L8 having a 41.93 percent solids content, 60.16 grams of Polywax 725 dispersion having a solids content of 30.67 percent, 44.9 grams of a Blue Pigment PB15:3 dispersion having a solids content of 17 percent into 647.7 grams of water with high shear stirring by means of a polytron. To this mixture was added 24 grams of a coagulant solution consisting of 10 weight percent poly(aluminiumchloride), PAC and 90 wt. % 0.02M $HNO_3$ solution. The PAC solution was added drop-wise at low rpm and as the viscosity of the pigmented latex mixture increased the rpm of the polytron probe also increased to 5,000 rpm for a period of 2 minutes. The slurry was heated at a controlled rate of 0.5° C./minute up to approximately 48° C. and held at this temperature or slightly higher to grow the particles to approximately 5.0 microns. Once the average particle size of 5.0 microns was achieved, 136.7 grams of the latex GW-L8 was then introduced into the reactor while stirring. After an additional 30 minutes to 1 hour the particle size measured was 5.7 microns with a GSD of 1.20. The pH of the resulting mixture was then adjusted from 2.0 to 7.0 with aqueous base solution of 4 percent sodium hydroxide and allowed to stir for an additional 15 minutes. Subsequently, the resulting mixture was heated to 93° C. at 1.0° C. per minute. The pH was then reduced to 6.5 using a 2.5 percent Nitric acid solution. The resultant mixture was then allowed to coalesce for 4 hrs at a temperature of 93° C. The particles were washed 6 times, where the 1st wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.83 microns with GSD=1.21.

Example 7

Preparation of EA Yellow Toner Particles GW-T82 from Latex GW-L8 Containing 9% Polywax 725

Into a 2 liter glass reactor equipped with an overhead stirrer and heating mantle was dispersed 278.4 grams of the above latex GW-L8 having a 41.93 percent solids content, 60.16 grams of Polywax 725 dispersion having a solids content of 30.67 percent, 67.1 grams of a Yellow Pigment PY74 dispersion having a solids content of 19.49 percent into 631.2 grams of water with high shear stirring by means of a polytron. To this mixture was added 24 grams of a coagulant solution consisting of 10 weight percent poly(aluminiumchloride), PAC and 90 wt. % 0.02M $HNO_3$ solution. The PAC solution was added drop-wise at low rpm and as the viscosity of the pigmented latex mixture increased the rpm of the polytron probe also increased to 5,000 rpm for a period of 2 minutes. The slurry was heated at a controlled rate of 0.5° C./minute up to approximately 48° C. and held at this temperature or slightly higher to grow the particles to approximately 5.0 microns. Once the average particle size of 5.0 microns was achieved, 136.7 grams of the latex GW-L8 was then introduced into the reactor while stirring. After an additional 30 minutes to 1 hour the particle size measured was 5.7 microns with a GSD of 1.20. The pH of the resulting mixture was then adjusted from 2.0 to 7.0 with aqueous base solution of 4 percent sodium hydroxide and allowed to stir for an additional 15 minutes. Subsequently, the resulting mixture was heated to 93° C. at 1.0° C. per minute. The pH was then reduced to 6.5 using a 2.5 percent Nitric acid solution. The resultant mixture was then allowed to coalesce for 4 hrs at a temperature of 93° C. The particles were washed 6 times, where the 1st wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.83 microns with GSD=1.21.

Example 8

Preparation of EA Black Toner Particles GW-T83 from Latex GW-L8 Containing 9% Polywax 725

Into a 2 liter glass reactor equipped with an overhead stirrer and heating mantle was dispersed 278.4 grams of the above latex GW-L8 having a 41.93 percent solids content, 60.16 grams of Polywax 725 dispersion having a solids content of 30.67 percent, 76 grams of a Black Pigment Regal 330 dispersion having a solids content of 16.92 percent into 631.2 grams of water with high shear stirring by means of a polytron. To this mixture was added 24 grams of a coagulant solution consisting of 10 weight percent poly(aluminiumchloride), PAC and 90 wt. % 0.02M $HNO_3$ solution. The PAC solution was added drop-wise at low rpm and as the viscosity of the pigmented latex mixture increased the rpm of the polytron probe also increased to 5,000 rpm for a period of 2 minutes. The slurry was heated at a controlled rate of 0.5° C./minute up to approximately 48° C. and held at this temperature or slightly higher to grow the particles to approximately 5.0 microns. Once the average particle size of 5.0 microns was achieved, 136.7 grams of the latex GW-L8 was then introduced into the reactor while stirring. After an additional 30 minutes to 1 hour the particle size measured was 5.7 microns with a GSD of 1.20. The pH of the resulting mixture was then adjusted from 2.0 to 7.0 with aqueous base solution of 4 percent sodium hydroxide and allowed to stir for an additional 15 minutes. Subsequently, the resulting mixture was heated to 93° C. at 1.0° C. per minute. The pH was then reduced to 6.5 using a 2.5 percent Nitric acid solution. The resultant mixture was then allowed to coalesce for 4 hrs at a temperature of 93° C. The particles were washed 6 times, where the 1st wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.83 microns with GSD=1.21.

Example 9

Preparation of EA Magenta Toner Particles GW-T84 from Latex GW-L8 Containing 9% Polywax 725

Into a 2 liter glass reactor equipped with an overhead stirrer and heating mantle was dispersed 273.5 grams of the above latex GW-L8 having a 41.93 percent solids content, 60.16 grams of Polywax 725 dispersion having a solids content of 30.67 percent, 49.3 grams of a Red Pigment PR122 dispersion having a solids content of 15.48 percent and 67.5 grams of a Red Pigment PR238 dispersion having a solids content of 11.3 percent into 541.4 grams of water with high shear stirring by means of a polytron. To this mixture was added 24 grams of a coagulant solution consisting of 10 weight percent poly(aluminiumchloride), PAC and 90 wt. % 0.02M $HNO_3$ solution. The PAC solution was added drop-wise at low rpm and as the viscosity of the pigmented latex mixture increased the rpm of the polytron probe also increased to 5,000 rpm for a period of 2 minutes. The slurry was heated at a controlled rate of 0.5° C./minute up to approximately 48° C. and held at this temperature or slightly higher to grow the particles to approximately 5.0 microns. Once the average particle size of 5.0 microns was achieved, 136.7 grams of the latex GW-L8 was then introduced into the reactor while stirring. After an additional 30 minutes to 1 hour the particle size measured was 5.7 microns with a GSD of 1.20. The pH of the resulting mixture was then adjusted from 2.0 to 7.0 with aqueous base solution of 4 percent sodium hydroxide and allowed to stir for an additional 15 minutes. Subsequently, the resulting mixture was heated to 93° C. at 1.0° C. per minute. The pH was then reduced to 6.5 using a 2.5 percent Nitric acid solution. The resultant mixture was then allowed to coalesce for 4 hrs at a temperature of 93° C. The particles were washed 6 times, where the 1st wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.83 microns with GSD=1.21.

Example 10

Preparation of EA Cyan Toner Particles GW-T85 from Latex GW-L8 Containing 12% Polywax 725

Into a 2 liter glass reactor equipped with an overhead stirrer and heating mantle was dispersed 283.2 grams of the above latex GW-L8 having a 41.93 percent solids content, 80.21 grams of Polywax 725 dispersion having a solids content of 30.67 percent, 44.9 grams of a Blue Pigment PB15:3 dispersion having a solids content of 17 percent into 647.7 grams of water with high shear stirring by means of a polytron. To this mixture was added 24 grams of a coagulant solution consisting of 10 weight percent poly(aluminiumchloride), PAC and 90 wt. % 0.02M $HNO_3$ solution. The PAC solution was added drop-wise at low rpm and as the viscosity of the pigmented latex mixture increased the rpm of the polytron probe also increased to 5,000 rpm for a period of 2 minutes. The slurry was heated at a controlled rate of 0.5° C./minute up to approximately 48° C. and held at this temperature or slightly higher to grow the particles to approximately 5.0 microns. Once the average particle size of 5.0 microns was achieved, 136.7 grams of the latex GW-L8 was then introduced into the reactor while stirring. After an additional 30 minutes to 1 hour the particle size measured was 5.7 microns with a GSD of 1.20. The pH of the resulting mixture was then adjusted from 2.0 to 7.0 with aqueous base solution of 4 percent sodium hydroxide and allowed to stir for an additional 15 minutes. Subsequently, the resulting mixture was heated to 93° C. at 1.0° C. per minute. The pH was then reduced to 6.5 using a 2.5 percent Nitric acid solution. The resultant mixture was then allowed to coalesce for 4 hrs at a temperature of 93° C. The particles were washed 6 times, where the 1st wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.83 microns with GSD=1.21.

Example 11

Preparation of EA Yellow Toner Particles GW-T86 from Latex GW-L8 Containing 12% Polywax 725

Into a 2 liter glass reactor equipped with an overhead stirrer and heating mantle was dispersed 263.7 grams of the above latex GW-L8 having a 41.93 percent solids content, 80.21 grams of Polywax 725 dispersion having a solids content of 30.67 percent, 66.5 grams of a Yellow Pigment PY-74 dispersion having a solids content of 19.68 percent into 626.6 grams of water with high shear stirring by means of a polytron. To this mixture was added 24 grams of a coagulant solution consisting of 10 weight percent poly(aluminiumchloride), PAC and 90 wt. % 0.02M $HNO_3$ solution. The PAC solution was added drop-wise at low rpm and as the viscosity of the pigmented latex mixture increased the rpm of the polytron probe also increased to 5,000 rpm for a period of 2 minutes. The slurry was heated at a controlled rate of 0.5° C./minute up to approximately 48° C. and held at this temperature or slightly higher to grow the particles to approximately 5.0 microns. Once the average particle size of 5.0 microns was achieved, 136.7 grams of the latex GW-L8 was then introduced into the reactor while stirring. After an additional 30 minutes to 1 hour the particle size measured was 5.7 microns with a GSD of 1.20. The pH of the resulting mixture was then adjusted from 2.0 to 7.0 with aqueous base solution of 4 percent sodium hydroxide and allowed to stir for an additional 15 minutes. Subsequently, the resulting mixture was heated to 93° C. at 1.0° C. per minute. The pH was then reduced to 6.5 using a 2.5 percent Nitric acid solution. The resultant mixture was then allowed to coalesce for 4 hrs at a temperature of 93° C. The particles were washed 6 times, where the 1st wash was conducted at pH of 10 at 63° C., followed by 3 washes with deionized water at room temperature, one wash carried out at a pH of 4.0 at 40 C., and finally the last wash with deionized water at room temperature. The final average particle size of the dried particles was 5.7 microns with GSD=1.21.

Example 12

Preparation of EA Black Toner Particles GW-T87 from Latex GW-L8 Containing 12% Polywax 725

Into a 2 liter glass reactor equipped with an overhead stirrer and heating mantle was dispersed 263.7 grams of the above latex GW-L8 having a 41.93 percent solids content, 80.21 grams of Polywax 725 dispersion having a solids content of 30.67 percent, 76 grams of a Black Pigment Regal 330 dispersion having a solids content of 16.92 percent into 615.4 grams of water with high shear stirring by means of a polytron. To this mixture was added 24 grams of a coagulant solution consisting of 10 weight percent poly(aluminiumchloride), PAC and 90 wt. % 0.02M $HNO_3$ solution. The PAC solution was added drop-wise at low rpm and as the viscosity of the pigmented latex mixture increased the rpm of the polytron probe also increased to 5,000 rpm for a period of 2 minutes. The slurry was heated at a controlled rate of 0.5° C./minute up to approximately 48° C. and held at this temperature or slightly higher to grow the particles to approximately 5.0 microns. Once the average particle size of 5.0 microns was achieved, 136.7 grams of the latex GW-L8 was then introduced into the reactor while stirring. After an additional 30 minutes to 1 hour the particle size measured was 5.7 microns with a GSD of 1.20. The pH of the resulting mixture was then adjusted from 2.0 to 7.0 with aqueous base solution of 4 percent sodium hydroxide and allowed to stir for an additional 15 minutes. Subsequently, the resulting mixture was heated to 93° C. at 1.0° C. per minute. The pH was then reduced to 6.5 using a 2.5 percent Nitric acid solution. The resultant mixture was then allowed to coalesce for 4 hrs at a temperature of 93° C. The particles were washed 6 times, where the 1st wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.83 microns with GSD=1.21.

Example 13

Preparation of EA Magenta Toner Particles GW-T88 from Latex GW-L8 Containing 12% Polywax 725

Into a 2 liter glass reactor equipped with an overhead stirrer and heating mantle was dispersed 258.8 grams of the above latex GW-L8 having a 41.93 percent solids content, 80.21 grams of Polywax 725 dispersion having a solids content of 30.67 percent, 49.3 grams of a Red Pigment PR122 dispersion having a solids content of 15.48 percent and 67.5 grams of a Red Pigment PR238 dispersion having a solids content of 11.3 percent into 642.3 grams of water with high shear stirring by means of a polytron. To this mixture was added 26 grams of a coagulant solution consisting of 10 weight percent poly(aluminiumchloride), PAC and 90 wt. % 0.02M $HNO_3$ solution. The PAC solution was added drop-wise at low rpm and as the viscosity of the pigmented latex mixture increased the rpm of the polytron probe also increased to 5,000 rpm for a period of 2 minutes. The slurry was heated at a controlled rate of 0.5° C./minute up to approximately 48° C. and held at this temperature or slightly higher to grow the particles to approximately 5.0 microns. Once the average particle size of 5.0 microns was achieved, 136.7 grams of the latex GW-L8 was then introduced into the reactor while stirring. After an additional 30 minutes to 1 hour the particle size measured was 5.7 microns with a GSD of 1.20. The pH of the resulting mixture was then adjusted from 2.0 to 7.0 with aqueous base solution of 4 percent sodium hydroxide and allowed to stir for an additional 15 minutes. Subsequently, the resulting mixture was heated to 93° C. at 1.0° C. per minute. The pH was then reduced to 6.5 using a 2.5 percent Nitric acid solution. The resultant mixture was then allowed to coalesce for 4 hrs at a temperature of 93° C. The particles were washed 6 times, where the 1st wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.83 microns with GSD=1.21.

Comparative Example 14

Preparation of S/nBA Cyan EA Toner GW-T9 Containing 9% Polywax 725

The reference toner used in this invention is EA GW-T9. This is a toner made at a pilot plant scale, which is used as a benchmark for the toner examples described above. The following example is a scaled down version at a 2 liter scale. Into a 2 liter glass reactor equipped with an overhead stirrer and heating mantle was dispersed 262.1 grams EA latex GW-L9 (Mw=34,800, Mn=11,000, Tg onset=50.6° C.) having a 41.4 percent solids content, 60.16 grams of Polywax 725 dispersion having a solids content of 30.67 percent, 64.1 grams of a Blue Pigment PB15:3 dispersion having a solids content of 17 percent into 588.8 grams of water with high shear stirring by means of a polytron. To this mixture was added 36 grams of a coagulant solution consisting of 3.6 grams poly(aluminiumchloride), PAC 32.4 grams 0.02M $HNO_3$ solution, 19 grams 40 nm colloidal silica Snowtex OL, solids content of 21.27% and 29 grams 12 nm colloidal silica Snowtex OS, solids content of 20.68%. The coagulant solution was added drop-wise at low rpm and as the viscosity of the pigmented latex mixture increased the rpm of the polytron probe also increased to 5,000 rpm for a period of 2 minutes. The slurry was heated at a controlled rate of 0.5° C./minute up to approximately 48° C. and held at this temperature or slightly higher to grow the particles to approximately 5.0 microns. Once the average particle size of 5.0 microns was achieved, 138.5 grams of the latex GW-L9 (EA12-48) was then introduced into the reactor while stirring. After an additional 30 minutes to 1 hour the particle size measured was 5.70 microns with a GSD of 1.20. The pH of the resulting mixture was then adjusted from 2.0 to 7.0 with aqueous base solution of 4 percent sodium hydroxide and allowed to stir for an additional 15 minutes. Subsequently, the resulting mixture was heated to 93° C. at 1.0° C. per minute. The pH was then reduced to 6.5 using a 2.5 percent Nitric acid solution. The resultant mixture was then allowed to coalesce for 4 hrs at a temperature of 93° C. The particles were washed 6 times, where the 1st wash was conducted at pH of 10 at 63° C., followed by 3 washes with deionized water at room temperature, one wash carried out at a pH of 4.0 at 40° C., and finally the last wash with deionized water at room temperature. The final average particle size of the dried particles was 5.70 microns with GSD=1.21.

Example 15

ICP Data

Elemental analysis for aluminum was measured for selected toners using inductively coupled plasma (ICP). It is well known that the amount of aluminum retained in a toner has an affect on the fusing performance of the toner. Typically, the higher the aluminum content in the toner, the higher the amount of ionically induced cross-linking within the toner, which lowers the gloss when the toner is fused. All example toners are prepared with a lower PAC loading and hence a lower aluminum content compared to the reference toner EA GW-T9. It should be noted here however that with the incorporation of colloidal silica as in the case of EA GW-T9, this results in aluminum being sequestered from the toner, and thus removing aluminum and ionic induced cross-linking. As a result, the aluminum content of all the toners are comparable, therefore any difference in gloss can be attributed to the change in toner resin molecular weight, and not in the aluminum content. Table 3 below shows the ICP aluminum data for selected toners.

TABLE 3

| ICP of Aluminum | |
|---|---|
| Toner | ICP Al ± 100 |
| GW-T81, C | 603 |
| GW-T82, Y | 679 |
| GW-T83, K | 644 |
| GW-T84, M | 634 |
| GW-T9 | 608 |
| GW-T85, C | 579 |
| GW-T87, K | 688 |
| GW-T88, M | 600 |

Example 16

Fusing Performance (Free Belt Nip Fuser)

Figure 3:
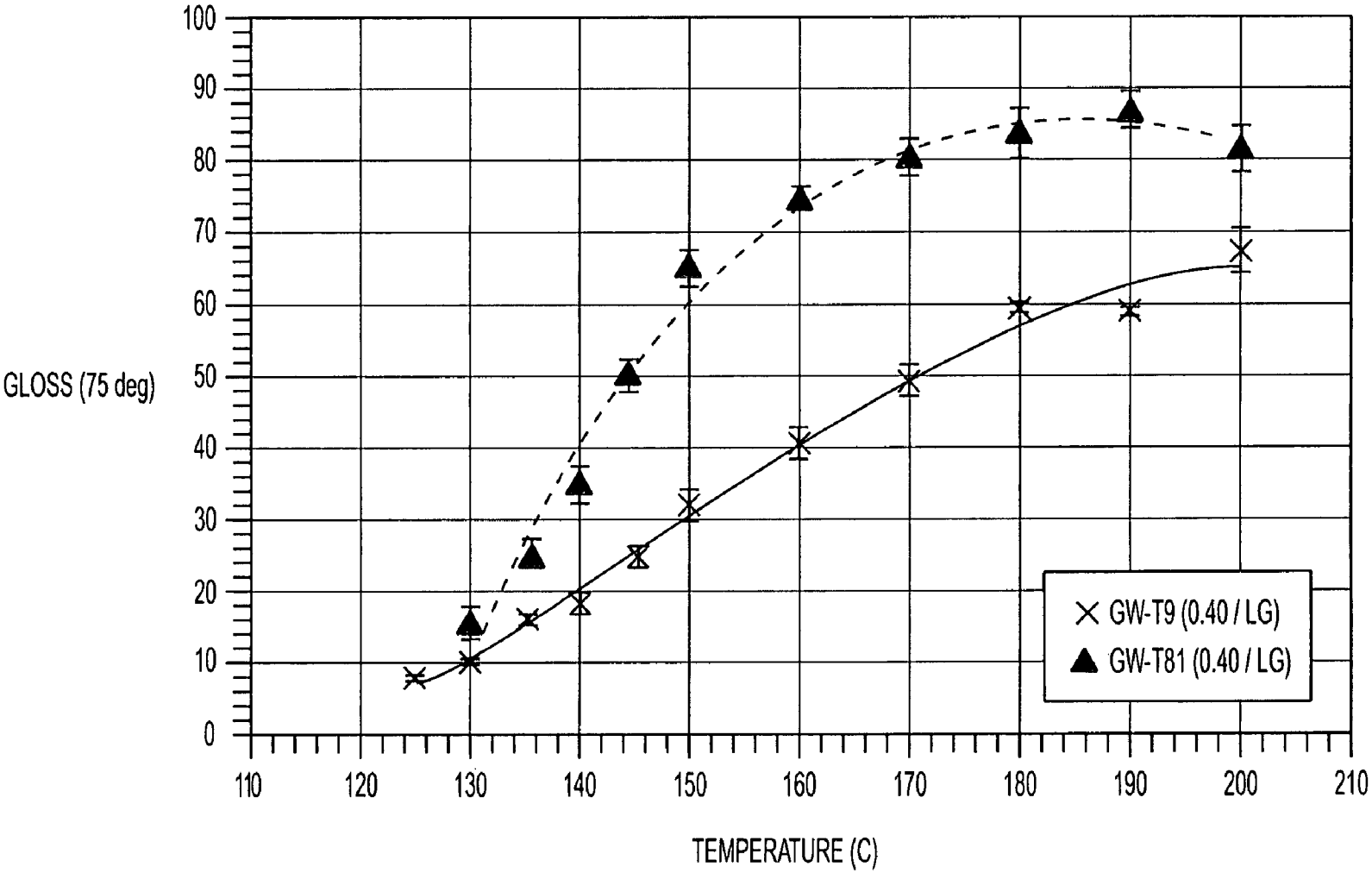
FIG. 3 shows the correlation between toner gloss versus temperature for toners according to an embodiment of the present disclosure.

FIG. 3 shows the fusing performance of EA GW-T9 and GW-T81 at 0.40 mg/cm$^2$ TMA on Lustro Gloss paper, as fused on the Free Belt Nip Fuser. Toner gloss for GW-T81 is 34 gloss units higher than the reference toner at a fusing temperature of 160° C.

Example 17

Crease Performance

Figure 4:
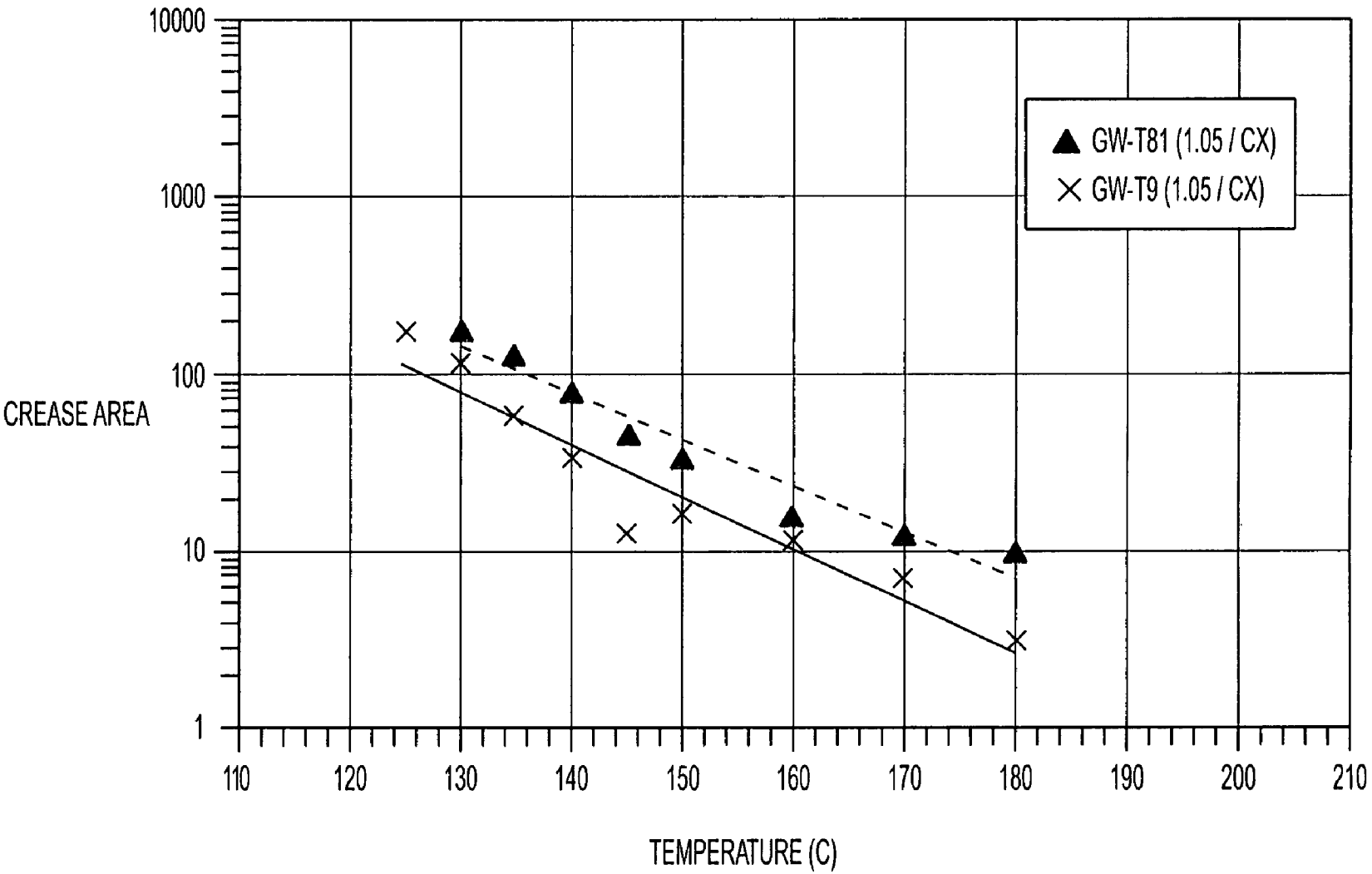
FIG. 4 shows the correlation between toner crease area versus temperature for toners according to an embodiment of the present disclosure.

FIG. 4 shows the crease performance of EA GW-T9 and GW-T81 at 1.05 mg/cm$^2$ TMA on Color Xpressions™ (CX) paper, as fused on the Free Belt Nip Fuser. Color Xpressions is a 90 gsm uncoated paper produced by Xerox Corporation. While the Crease MFT for GW-T81 is higher than for EA GW-T9, it is still within the IMARI specification.

Example 18

Stripping Performance

Figure 5:
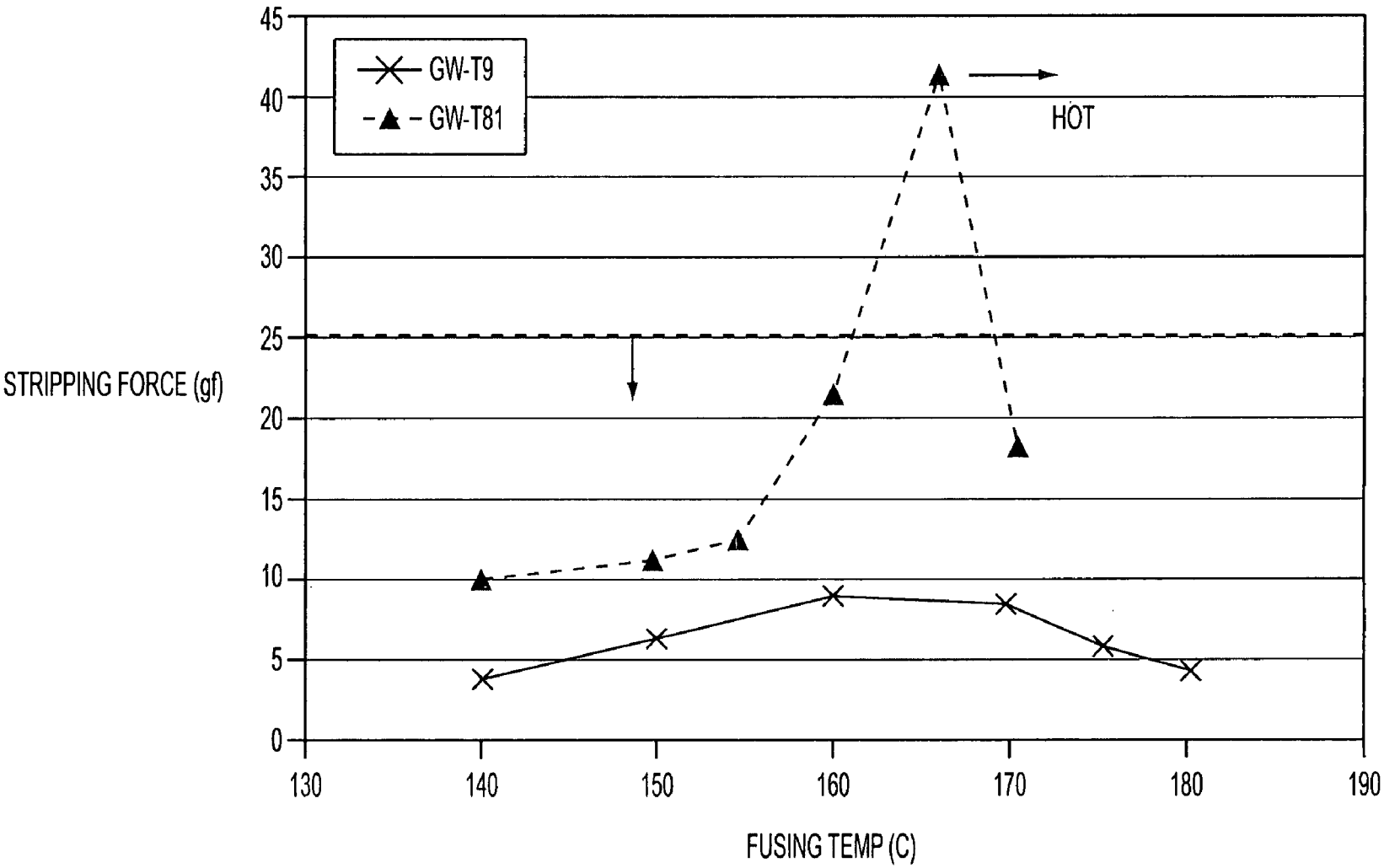
FIG. 5 shows the correlation between toner stripping force versus fusing temperature for toners according to an embodiment of the present disclosure.

FIG. 5 shows the stripping performance of EA GW-T9 and GW-T81 at 1.25 mg/cm$^2$ TMA on S-paper, as fused on the Stripping Force Fixture. S-Paper is a 56 gsm uncoated paper produced by Fuji Xerox Corporation. GW-T81 has high stripping force due to the lower molecular weight latex in the toner. Stripping force can be reduced by adding more wax to the toner formulation, as shown FIG. 8.

Example 19

Fusing Performance

Figure 6:
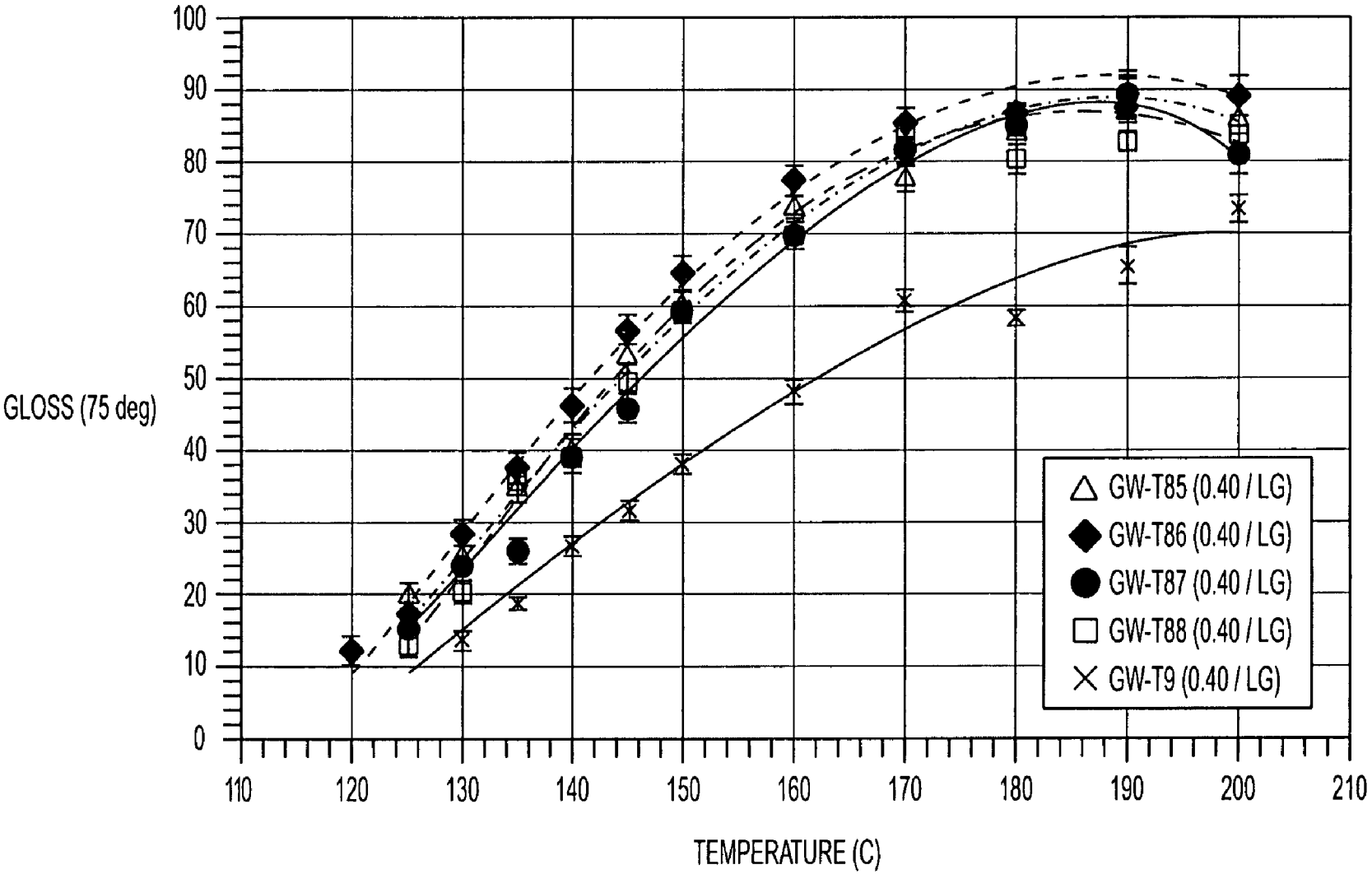
FIG. 6 shows the correlation between toner gloss versus temperature for toners according to an embodiment of the present disclosure.

FIG. 6 shows the fusing performance of EA GW-T9 and the CMYK toners made with latex GW-L8 at 0.40 mg/cm$^2$ TMA on Lustro Gloss paper, as fused on the Free Belt Nip Fuser. These toners were prepared using 12 weight percent wax in order to improve stripping performance. Fused image gloss for the toners is a minimum of 23 gloss units higher than the reference toner at a fusing temperature of 160° C.

Example 20

Crease Performance

Figure 7:
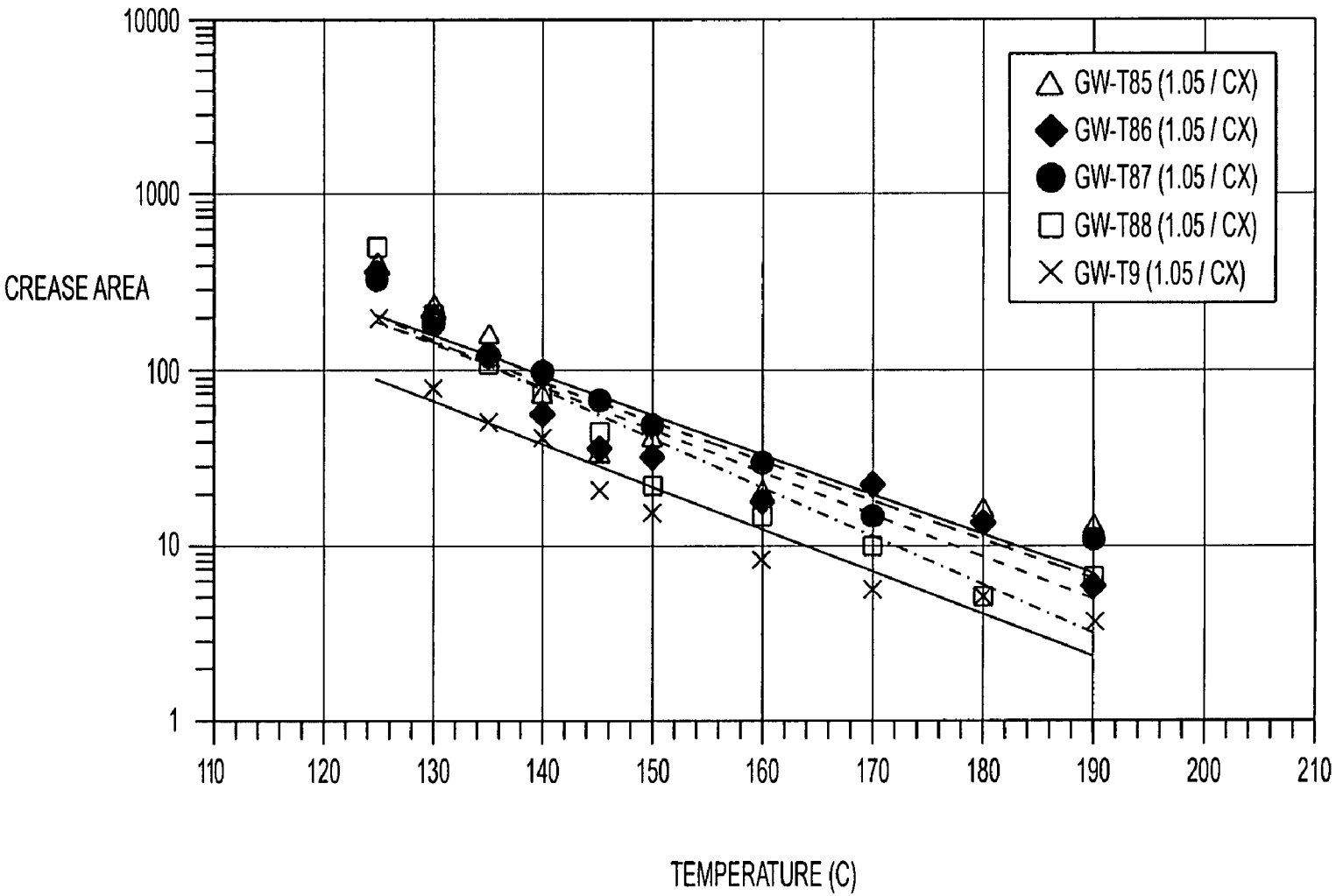
FIG. 7 shows the correlation between crease area versus temperature for toners according to an embodiment of the present disclosure.

FIG. 7 shows the crease performance of EA GW-T9 and the CMYK toners made from latex GW-L8 with 12 weight % wax, at 1.05 mg/cm$^2$ TMA on Color Xpressions paper, as fused on the Free Belt Nip Fuser. While the Crease MFT for the CMYK toners with 12 weight % wax is higher than for EA GW-T9, they are still within the IMARI specification.

Example 21

Stripping Performance

Figure 8:
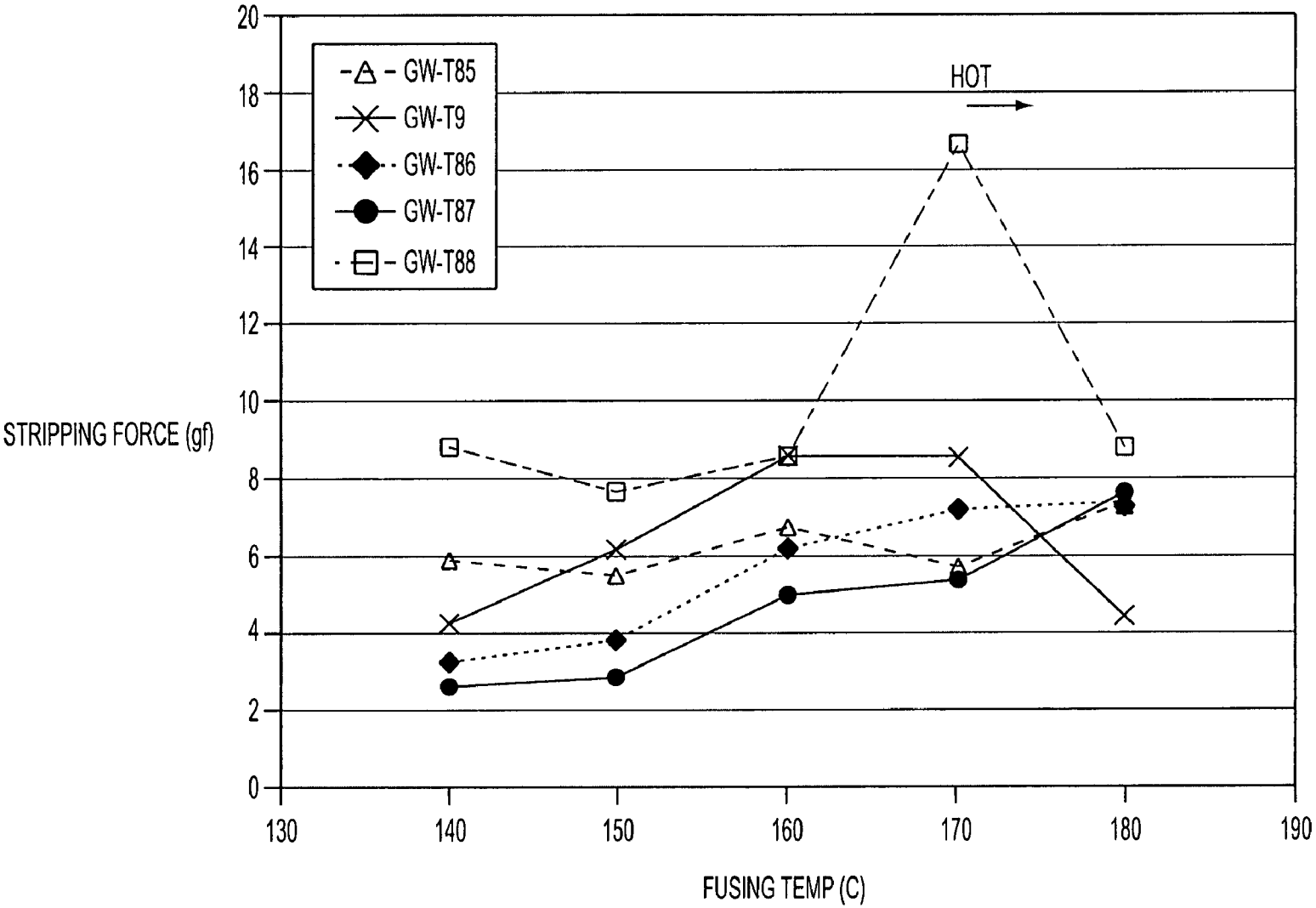
FIG. 8 shows the correlation between stripping force versus temperature for toners according to an embodiment of the present disclosure.

FIG. 8 shows the stripping performance of EA GW-T9 and the CMYK toners made from latex GW-L8 at 1.25 mg/cm$^2$ TMA on S-paper, as fused on the Stripping Force Fixture. By increasing the wax content from 9 to 12 weight %, the stripping force has been reduced significantly, and all meet the IMARI specification.

Example 22

Document Offset

Figure 9:
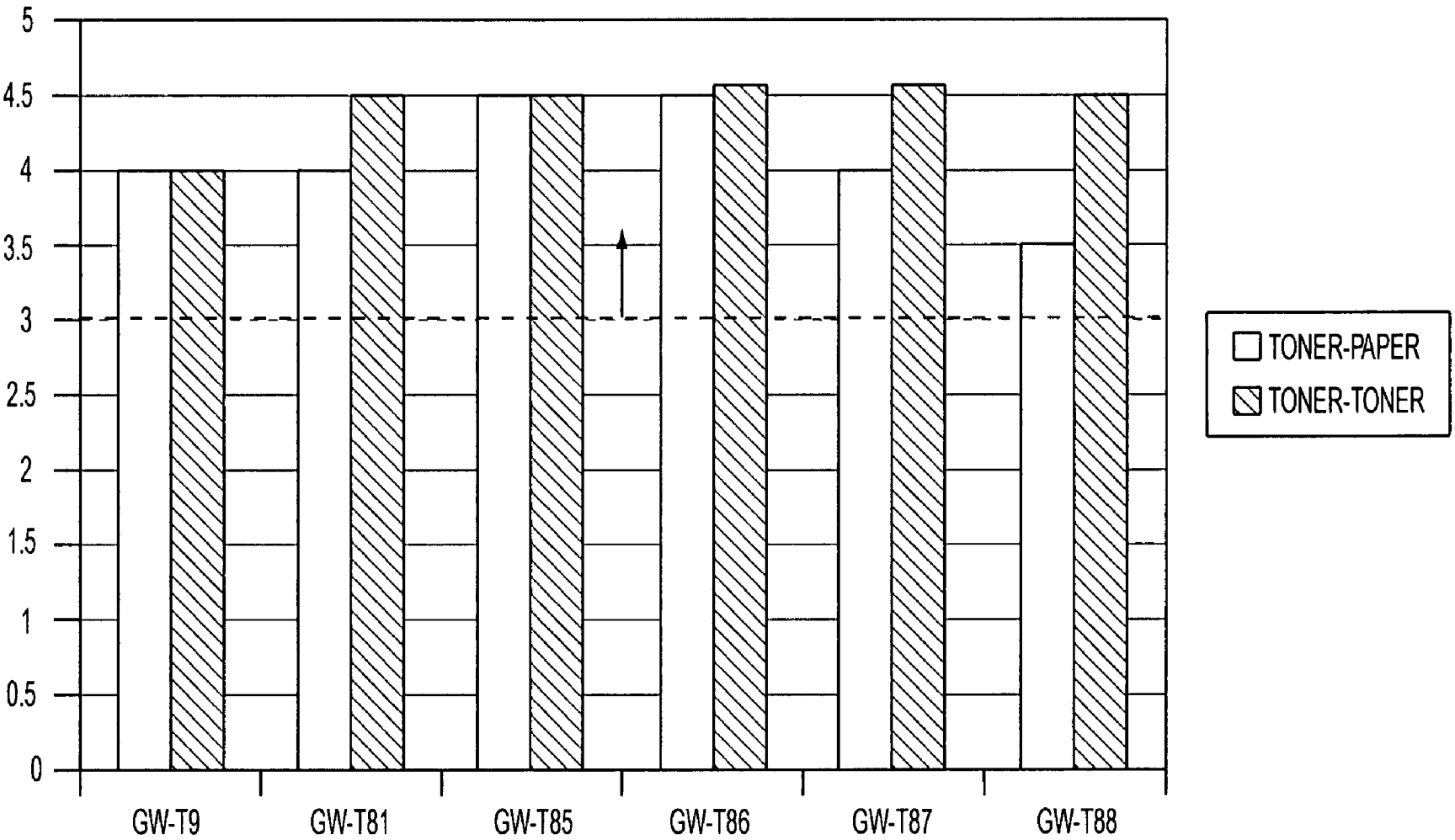
FIG. 9 shows the document offsets on CX paper for toners according to an embodiment of the present disclosure.

FIG. 9 shows document offset on CX paper for all the above toners. All toners have excellent document offset that meets or exceeds the IMARI specification.

Example 23

Vinyl Offset

Figure 10:
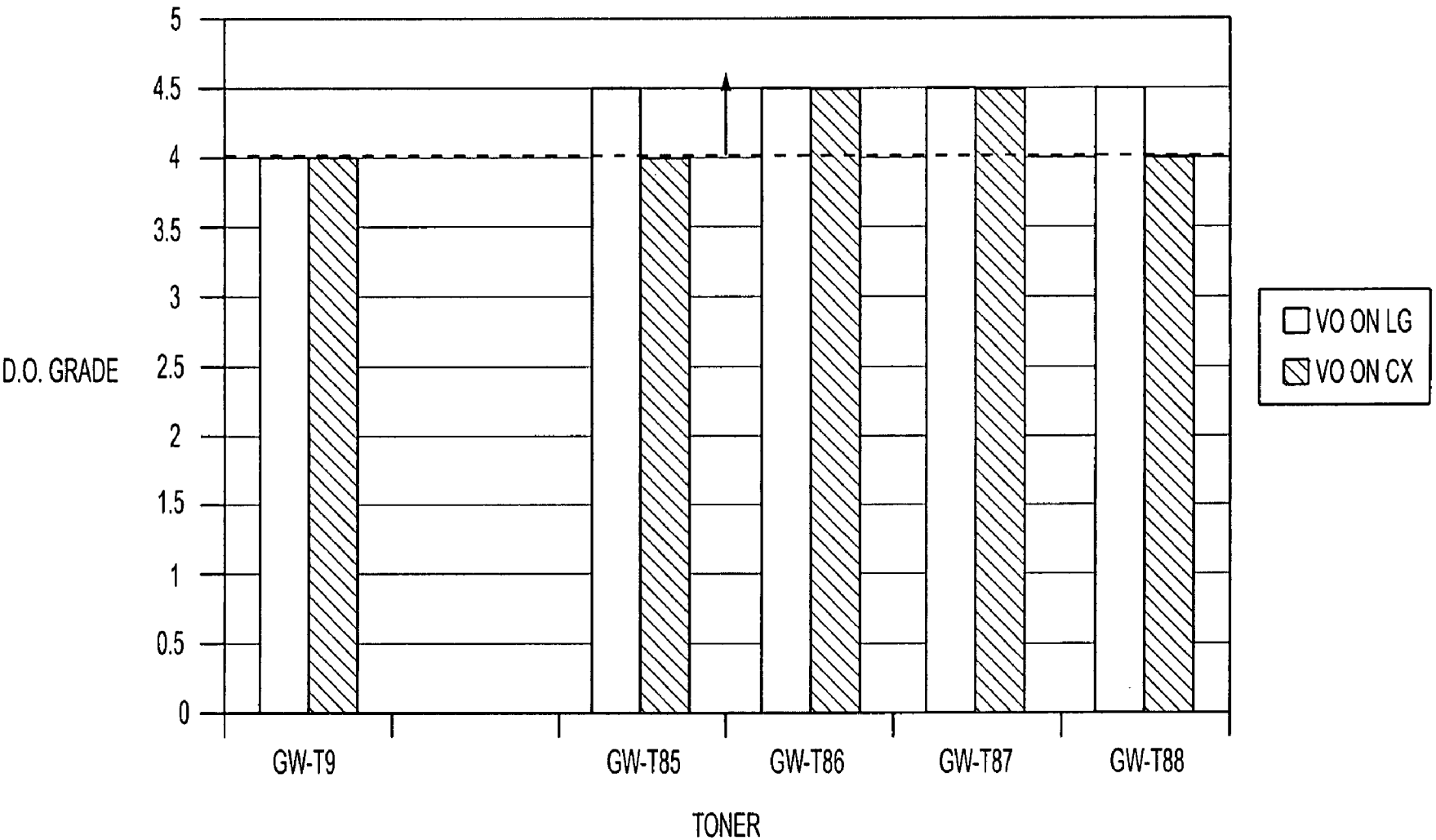
FIG. 10 shows the vinyl offsets for some toners according to an embodiment of the present disclosure.

FIG. 10 shows vinyl offset (VO) on LG and CX paper for the 12 weight percent wax toners. All toners have excellent vinyl offset that meets or exceeds the IMARI specification.

Example 24

Fusing Performance (Belt Fuser)

Figure 11:
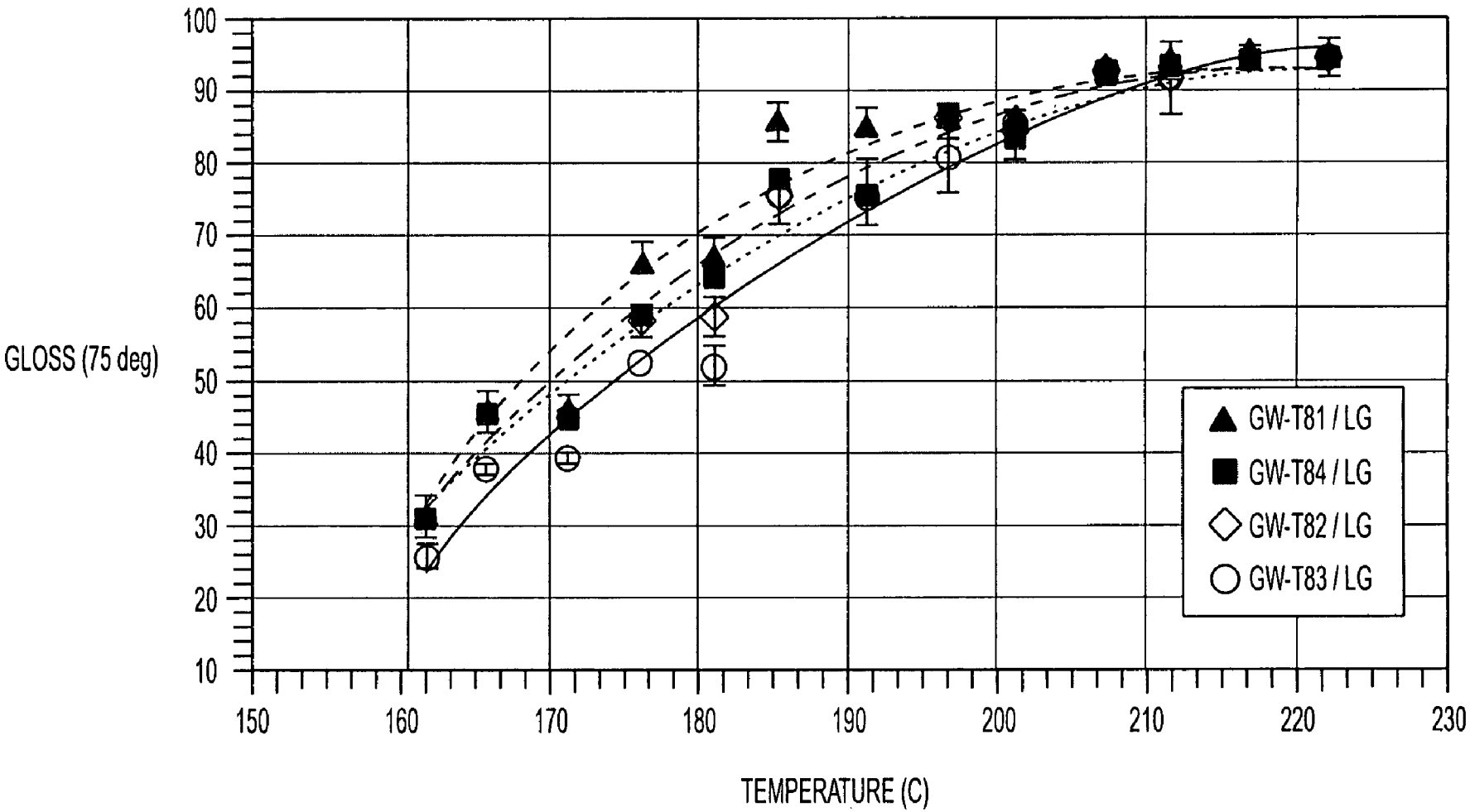
FIG. 11 shows the correlation between toner gloss versus temperature for toners according to an embodiment of the present disclosure.

FIG. 11 shows the fusing performance of the 9 weight percent wax CMYK toners on Lustro Gloss paper at 0.45 mg/cm$^2$ TMA as fused on the Belt Fuser. All achieve gloss values>90 gloss units at an External Heat Roll temperature of 210° C.

Example 25

Crease Performance

Figure 12:
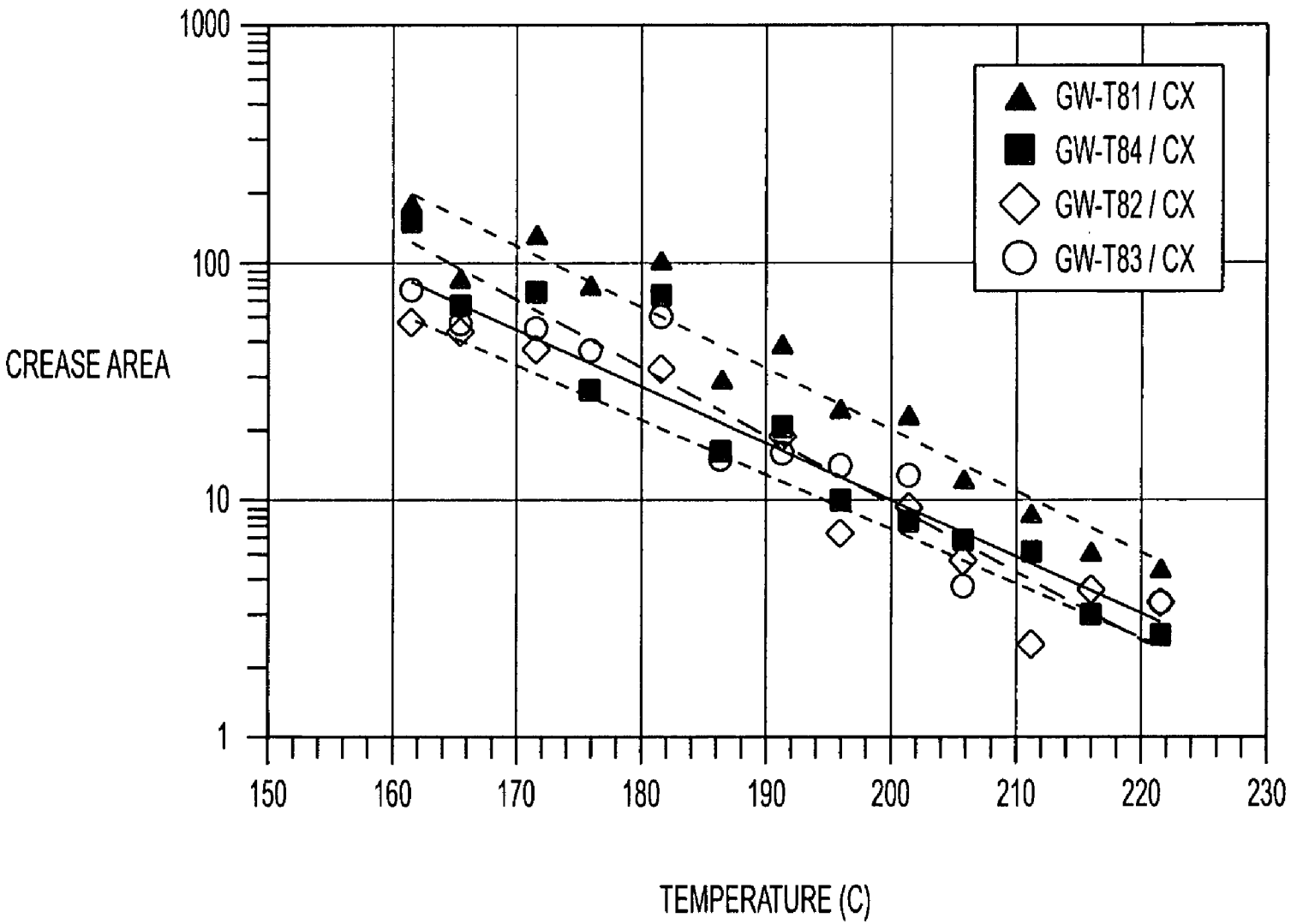
FIG. 12 shows the correlation between crease area versus temperature for toners according to an embodiment of the present disclosure.

FIG. 12 shows toner crease of the 9 weight percent wax CMYK toners on Color Xpressions paper at 1.05 mg/cm$^2$ TMA as fused on the Belt Fuser. All achieve gloss values>80 at an External Heat Roll temperature of 210° C. Since the Belt Fuser employs Release Oil, there is no issue with Stripping Force for these toners.

Example 26

Document Offset

Figure 13:
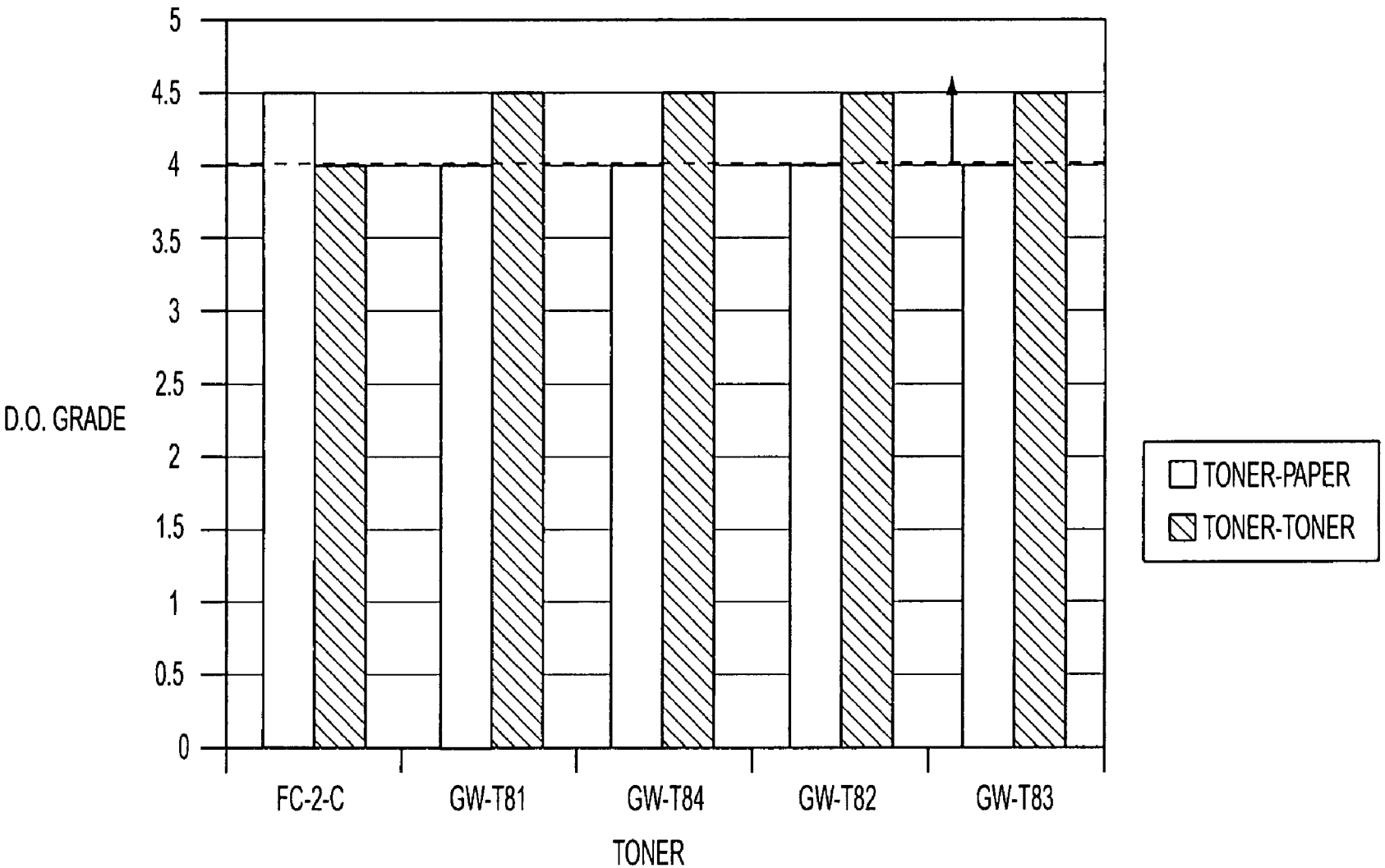
FIG. 13 shows the document offsets on CX paper for some toners according to an embodiment of the present disclosure.

FIG. 13 shows document offset on CX paper for the 9 weight percent wax toners fused on the Belt Fuser. All toners have excellent document offset. FC-2 is a conventional polyester toner used as a control in the Belt Fuser.

Example 27

Vinyl Offset

Figure 14:
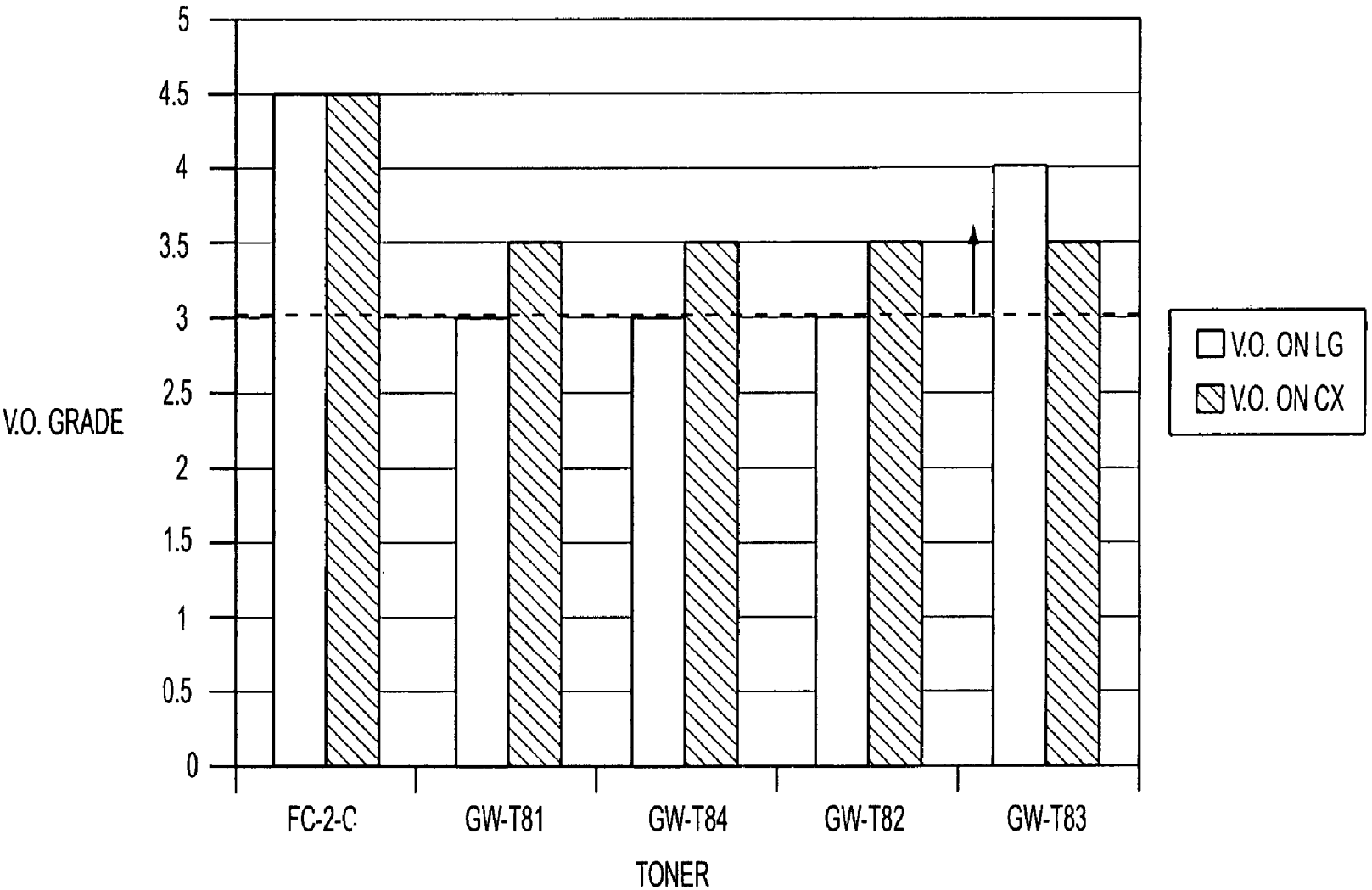
FIG. 14 shows the vinyl offsets for some toners according to an embodiment of the present disclosure.

FIG. 14 shows vinyl offset on LG and CX paper for the 9 weight percent wax toners fused on the belt fuser. All toners have acceptable vinyl offset.

Example 28

Charging Performance

Figure 15:
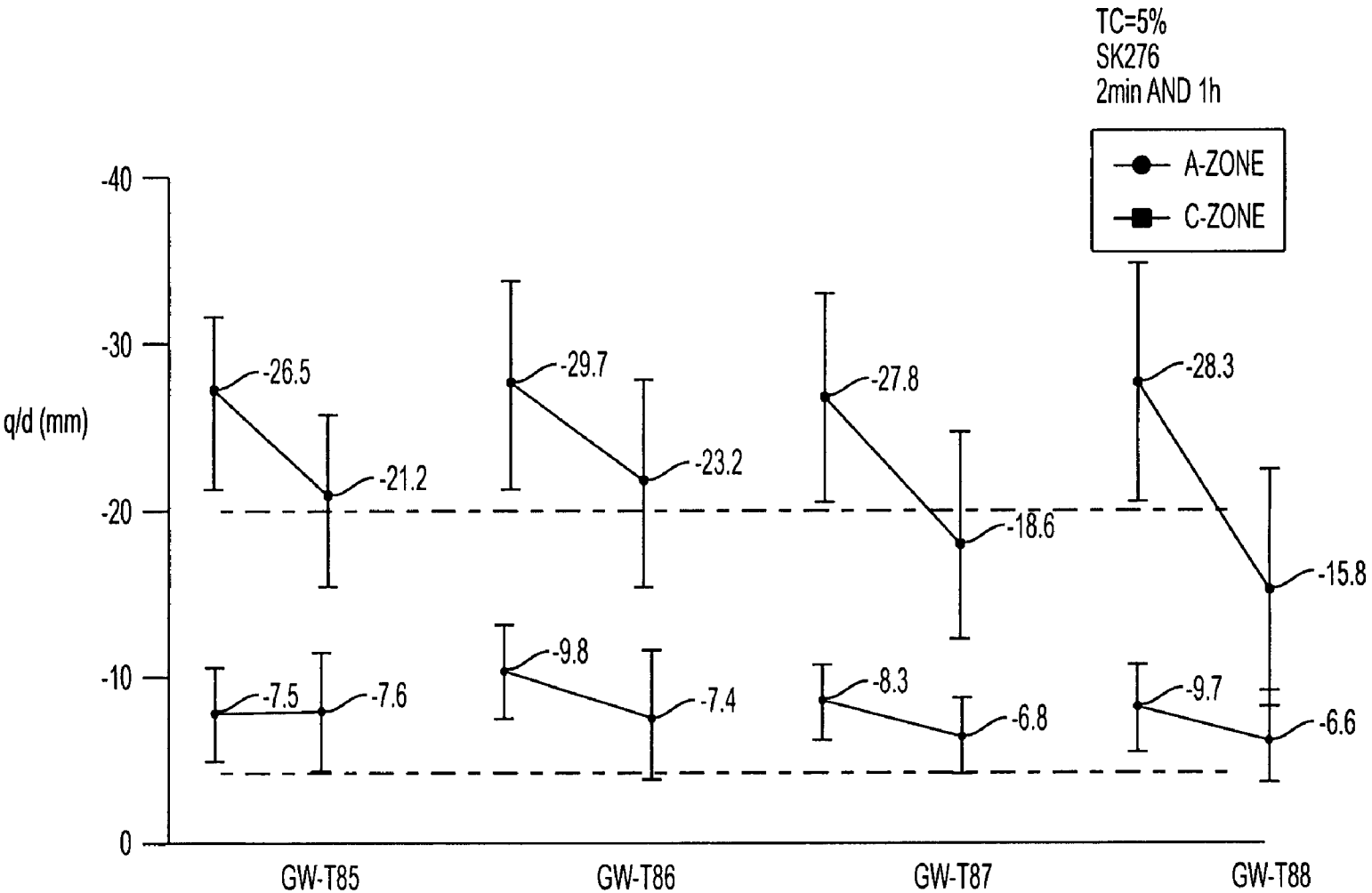
FIG. 15 shows the parent chargings for some toners according to an embodiment of the present disclosure.

FIG. 15 shows the parent charging of GW-T85, GW-T86, GW-T87, and GW-T88 CMYK toners made with 12 weight % Wax. Charging passes IMARI specifications.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A process for producing a toner comprising (a) preparing a latex seed comprising a first monomer composition, an initiator and an optional chain transfer agent by emulsion polymerization;

(b) feeding a second monomer composition to the latex seed under monomer-starved polymerization condition to form a latex having weight average molecular weight of from about $12\times10^3$ to about $25\times10^3$; and (c) mixing the latex with a colorant dispersion, a wax dispersion, and a coagulant.

2. The process according to claim 1, in which the monomer-starved polymerization condition comprises a feeding rate of the second monomer composition into the latex seed equal to or less than 0.516% per minute by weight of the monomer(s) to be fed.

3. The process according to claim 2, in which the feeding rate of the second monomer composition into the latex seed is from about 0.400% wt/min to about 0.500% wt/min.

4. The process according to claim 3, in which the feeding rate of the second monomer composition into the latex seed is from about 0.450% wt/min to about 0.500% wt/min.

5. The process according to claim 1, the latex has weight average molecular weight of from about $18\times10^3$ to about $22\times10^3$.

6. The process according to claim 1, in which the latex having weight average molecular weight of from about $12\times10^3$ to about $25\times10^3$ is present in an amount from about 50% to about 100%, based on the total toner weight.

7. The process according to claim 1, in which the ratio between the total monomer and the total initiator may be in the range of from about 5 kilograms to about 30 kilograms of total monomer per mole of initiator.

8. The process according to claim 1, in which the ratio between the total monomer and the total chain transfer is in the range of from about 1 kilograms to about 20 kilograms of total monomer per mole of chain transfer agent.

9. The process according to claim 1, in which the colorant is selected from the group consisting of Pigment Blue 15:3, Yellow Pigment PY74, Black Pigment REGAL 330, Red Pigment PR122; magnetites, phthalocyanines, HELIOGEN BLUE L6900, D6840, D7080, D7020, PYLAM OIL BLUE, PYLAM OIL YELLOW, and PIGMENT BLUE 1; PIGMENT VIOLET 1, PIGMENT RED 48, LEMON CHROME YELLOW DCC 1026, E.D. TOLUIDINE RED, and BON RED C; NOVAPERM YELLOW FGL and HOSTAPERM PINK E; CINQUASIA MAGENTA; 2,9-dimethyl-substituted quinacridone and anthraquinone dyes identified in the Color Index as CI 60710, CI Dispersed Red 15, diazo dyes identified in the Color Index as CI 26050, CI Solvent Red 19, copper tetra (octadecyl sulfonamido) phthalocyanine, x-copper phthalocyanine pigment listed in the Color Index as CI 74160, CI Pigment Blue, Anthrathrene Blue, identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Permanent Yellow FGL, Pigment Yellow 74, B 15:3 cyan pigment dispersion; Magenta Red 81:3 pigment dispersion; Yellow 180 pigment dispersion; colored magnetites, mixtures of MAPICO BLACK® and cyan components; Pigment Yellow 17, Pigment Yellow 14, Pigment Yellow 93, Yellow Pigment PY74, Pigment Violet 23, Pigment Violet 1, Pigment Green 7, Pigment Orange 36, Pigment Orange 21, Pigment Orange 16, Pigment Red 185, Pigment Red 122, Pigment Red 81:3, Pigment Blue 15:3, and Pigment Blue 61, and mixture thereof.

10. The process according to claim 1, in which the wax is selected from the group consisting of polyethylene wax, POLYWAX 725 wax emulsion, Fischer-Tropsch wax; vegetable wax, carnauba wax, Japan wax, Bayberry wax, rice wax, sugar cane wax, candelilla wax, tallow, jojoba oil; animal wax, beeswax, Shellac wax, Spermaceti wax, whale wax, Chinese wax, lanolin; ester wax; saturated fatty acid amides wax, capronamide, caprylamide, pelargonic amide, capric amide, laurylamide, tridecanoic amide, myristylamide, stearamide, behenic amide, ethylene-bisstearamide; unsaturated fatty acid amides wax, caproleic amide, myristoleic amide, oleamide, elaidic amide, linoleic amide, erucamide, ricinoleic amide, linolenic amide; mineral wax, montan wax, ozokerite, ceresin, and lignite wax; petroleum wax, paraffin wax, microcrystalline wax; polyolefin wax, low-molecular polyethylene, low-molecular polypropylene, low-molecular polybutene; synthetic wax, polytetrafluoroethylene wax, Akura wax, distearyl ketone; hydrogenated wax, castor wax, opal wax; modified wax, montan wax derivative, paraffin wax derivative, microcrystalline wax derivative, and mixture thereof.

11. The process according to claim 1, in which the coagulants is selected from the group consisting of include polyaluminum chloride (PAC), polyaluminum bromide, polyaluminum fluoride, polyaluminum iodide, polyaluminum halide, polyaluminum silicate, polyaluminum sulfo silicate (PASS), water soluble metal salt, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, and the mixture thereof.

12. The process according to claim 1, which is conducted by (i) preparing or providing a surfactant solution in water such as de-ionized water, optionally purged with inert gas;

(ii) heating the surtactant solution to an elevated temperature of from about 65° C. to about 95° C.;

(iii) preparing or providing an initiator solution in water;

(iv) preparing or providing a first monomer composition in emulsion;

(v) adding the first monomer composition into the surfactant solution;

(vi) adding at least a portion of the initiator solution into the surfactant solution before, during or simultaneously with the adding of the first monomer composition, thereby forming a latex seed;

(vii) feeding a second monomer composition, which may be the same as or different from the first monomer composition, into the latex seed under monomer-starved polymerization condition, thereby forming a latex having weight average molecular weight of from about $12\times10^3$ to about $25\times10^3$;

(viii) mixing a first portion of the latex with a colorant dispersion, a wax dispersion, and a coagulant, thereby forming a toner slurry;

(ix) heating the toner slurry at or below the glass transition temperature of the latex polymer to form toner sized aggregates;

(x) adding a second portion of the latex into the toner sized aggregates;

(xi) adjusting the pH of the emulsion system with a base from a pH of about 2.0 to about 2.5, to a pH of about 6.5 to about 7.0 to prevent, or minimize additional particle growth;

(xii) heating the toner sized aggregates at a coalescence temperature which is above the glass transition temperature of the latex polymer, thereby coalescing the toner sized aggregates into toner particles;

(xiii) optionally treating the toner particles with acidic solutions; and (xiv) optionally isolating, washing, and drying the toner particle.

13. A toner, which is prepared from a toner formulation comprising a latex having weight average molecular weight of from about $12\times10^3$ to about $25\times10^3$, a colorant dispersion, a wax dispersion, a coagulant, and an optional ingredient selected from the group consisting of silica, a charge enhancing additive or charge control additive, a surfactant, an emulsifier, a flow additive, and the mixture thereof;

wherein the toner produces an image having a gloss value at least about 8 gloss units higher than EA toner prepared from a formulation comprising a latex having a weight average molecular weight higher than about $25\times10^3$.

14. The toner according to claim 13, in which the latex has weight average molecular weight of from about $18\times10^3$ to about $22\times10^3$.

15. The toner according to claim 14, in which the latex has weight average molecular weight of from about $19\times10^3$ to about $20\times10^3$.

16. The toner according to claim 13, in which the latex having weight average molecular weight of from about $12\times10^3$ to about $25\times10^3$ is present in an amount from about 50% to about 100%, based on the total toner weight.

17. The toner according to claim 13, which produces an image having a gloss value at least about 12 gloss units higher than EA toner prepared from a formulation comprising a latex having a weight average molecular weight higher than about $25\times10^3$.

18. The toner according to claim 17, which produces an image having a gloss value at least about 15 gloss units higher than EA toner prepared from a formulation comprising a latex having a weight average molecular weight higher than about $25\times10^3$.

* * * * *